US010514188B2

(12) United States Patent
Xiong et al.

(10) Patent No.: US 10,514,188 B2
(45) Date of Patent: Dec. 24, 2019

(54) LASER COOLING OF ORGANIC-INORGANIC LEAD HALIDE PEROVSKITES

(71) Applicant: NANYANG TECHNOLOGICAL UNIVERSITY, Singapore (SG)

(72) Inventors: Qihua Xiong, Singapore (SG); Son Tung Ha, Singapore (SG); Chao Shen, Singapore (SG); Jun Zhang, Singapore (SG)

(73) Assignee: NANYANG TECHNOLOGICAL UNIVERSITY, Singapore (SG)

( * ) Notice: Subject to any disclaimer, the term of this patent is extended or adjusted under 35 U.S.C. 154(b) by 218 days.

(21) Appl. No.: 14/887,755

(22) Filed: Oct. 20, 2015

(65) Prior Publication Data

US 2016/0109167 A1 Apr. 21, 2016

(30) Foreign Application Priority Data

Oct. 20, 2014 (SG) ..... 10201406791Q

(51) Int. Cl.
*F25B 23/00* (2006.01)

(52) U.S. Cl.
CPC ..... *F25B 23/00* (2013.01); *F25B 23/003* (2013.01)

(58) Field of Classification Search
CPC ..... F25B 23/00; H01S 3/04; H01S 3/08054; H01S 3/042; H01L 23/34; H01L 2924/0002; C09K 11/664; G02F 2/02
See application file for complete search history.

(56) References Cited

U.S. PATENT DOCUMENTS 3,949,319 A * 4/1976 Tofield ..... H01S 3/094 372/68
4,377,864 A * 3/1983 McCollum ..... H01S 3/1688 372/41
4,580,269 A * 4/1986 Salour ..... H01S 5/14 372/36
5,615,558 A * 4/1997 Cornell ..... F25B 23/003 62/264
7,008,559 B2 * 3/2006 Chen ..... C09K 11/574 252/301.4 R
8,748,219 B2 * 6/2014 Tischler ..... H01S 3/0627 257/40
9,181,475 B2 * 11/2015 Kanatzidis ..... H01L 31/032
9,484,475 B2 * 11/2016 Rappe ..... H01L 31/032
9,660,111 B2 * 5/2017 Vockic ..... H01L 31/055
9,680,278 B2 * 6/2017 Xiong ..... H01S 3/04
(Continued)

FOREIGN PATENT DOCUMENTS

WO WO-2004061923 A1 * 7/2004 ..... C30B 29/406
WO WO-2013171520 A1 * 11/2013 ..... H01L 51/4213

OTHER PUBLICATIONS

Pringsheim, P. Zwei Bemerkungen über den Unterschied von Lumineszenz- und Temperaturestrahlung. Z. Phys. A 57, 739-746 (1929).

(Continued)

*Primary Examiner* — Frantz F Jules
*Assistant Examiner* — Martha Tadesse
(74) *Attorney, Agent, or Firm* — Sughrue Mion, PLLC

(57) ABSTRACT

The invention relates generally to cooling matter using laser emission, and in particular, to cooling perovskite materials using laser emission.

18 Claims, 24 Drawing Sheets

(56) References Cited

U.S. PATENT DOCUMENTS

2004/0129922 A1* 7/2004 Shibuya ..... C09K 11/06 252/301.36
2009/0279068 A1* 11/2009 Letz ..... G02B 1/02 355/77
2012/0312028 A1* 12/2012 Kashyap ..... F25B 23/00 62/3.1
2013/0336348 A1 12/2013 Xiong et al.

OTHER PUBLICATIONS

Epstein, R. I. Observation of laser-induced fluorescent cooling of solid. Nature 377, 500-503 (1995).
Gosnell, T. R. Laser cooling of a solid by 65K starting from room temperature. Opt. Lett. 24, 1041-1043 (1999).
Seletskiy, D. V. et al. Laser cooling of solids to cryogenic temperatures. Nature Photon. 4, 161-164 (2010).
Seletskiy, D. V. et al. Local laser cooling of Yb:YLF to 110 K. Opt. Express 19, 18229-18236 (2011).
Melgaard, S., Seletskiy, D., Polyak, V., Asmerom, Y. & Sheik-Bahae, M. Identification of parasitic losses in Yb:YLF and prospects for optical refrigeration down to 80K. Opt. Express 22, 7756-7764 (2014).
Zhang, J., Li, D., Chen, R. & Xiong, Q. H. Laser cooling of a semiconductor by 40 kelvin. Nature 493, 504-508 (2013).
Sheik-Bahae, M. & Epstein, R. I. Optical refrigeration. Nature Photon. 1, 693-699 (2007).
Sheik-Bahae, M. & Epstein, R. I. Can Laser Light Cool Semiconductors? Phys. Rev. Lett. 92, 247403 (2004).
Burschka, J. et al. Sequential deposition as a route to high-performance perovskite-sensitized solar cells. Nature 499, 316-319 (2013).
Lee, M. M., Teuscher, J., Miyasaka, T., Murakami, T. N. & Snaith, H. J. Efficient hybrid solar cells based on meso-superstructured organometal halide perovskites. Science 338, 643-647 (2012).
Stranks, S. D. et al. Electron-hole diffusion lengths exceeding 1 micrometer in an organometal trihalide perovskite absorber. Science 342, 341-344 (2013).
Xing, G. et al. Long-range balanced electron- and hole-transport lengths in organic-inorganic CH3NH3Pbl3. Science 342, 344-347 (2013).
Xing, G. et al. Low-temperature solution-processed wavelength-tunable perovskites for lasing. Nature materials 13, 476-480 (2014).
Wehrenfennig, C., Eperon, G. E., Johnston, M. B., Snaith, H. J. & Herz, L. M. High Charge Carrier Mobilities and Lifetimes in Organolead Trihalide Perovskites. Adv. Mater. 26, 1584-1589 (2014).
Ha, S. T., Liu, X. F., Zhang, Q., Sum, T. C. & Xiong, Q. H. Synthesis of organic-inorganic lead halide perovskite nanoplatelets: Towards high performance perovskite solar cells and opto-electronic devices. Adv. Opt. Mat. (2014).
Baikie, T. et al. Synthesis and crystal chemistry of the hybrid perovskite (CH3NH3)Pbl3 for solid-state sensitised solar cell applications. J. Mater. Chem. A 1, 5628-5641 (2013).
Yu, C. L. et al. Temperature dependence of the band gap of perovskite semiconductor compound CsSnl3. J. Appl. Phys. 110, 063526 (2011).
Roosbroeck, W. V. & Shockley, W. Photon-Radiative Recombination of Electrons and Holes in Germanium. Phys. Rev. 94 (1954).
Mosconi, E., Amat, A., Nazeeruddin, M. K., Grätzel, M. & De Angelis, F. First-Principles Modeling of Mixed Halide Organometal Perovskites for Photovoltaic Applications. J. Phys. Chem. C 117, 13902-13913 (2013).
Stoumpos, C. C., Malliakas, C. D. & Kanatzidis, M. G. Semiconducting tin and lead iodide perovskites with organic cations: phase transitions, high mobilities, and near-infrared photoluminescent properties. Inorganic chemistry 52, 9019-9038 (2013).
Garcia-Adeva, A. J., Balda, R. & Fernandez, J. Upconversion cooling of Er-doped low-phonon fluorescent solids. Phys. Rev. B 79, 033110 (2009).
Chen, R. et al. Excitonic Properties and Near-Infrared Coherent Random Lasing in Vertically Aligned CdSe Nanowires. Advanced Materials 23, 1404-1408 (2011).
Utama, M. I. et al. Vertically aligned cadmium chalcogenide nanowire arrays on muscovite mica: a demonstration of epitaxial growth strategy. Nano letters 11, 3051-3057 (2011).
http://wvvw.cmmp-france.com/micamugb.html.
Khurgin, J. B. Band gap engineering for laser cooling of semiconductors. J. Appl. Phys. 100, 113116 (2006).
Khurgin, J. B. Surface plasmon-assisted laser cooling of solids. Phys. Rev. Lett. 98, 177401 (2007).
Khurgin, J. B. Role of bandtail states in laser cooling of semiconductors. Phys. Rev. B 77, 235206 (2008).
Rupper, G., Kwong, N. H. & Binder, R. Large excitonic enhancement of optical refrigeration in semiconductors. Phys. Rev. Lett. 97, 117401 (2006).
Mitzi, D. B. Thin-film deposition of organic-inorganic hybrid materials. Chem. Mater. 13, 3283-3298 (2001).
Kitazawa, N. & Watanabe, Y. Optical properties of natural quantum-well compounds (C6H5—CnH2n—NH3)(2)PbBr4 (n=1-4). J. Phys. Chem. Solids 71, 797-802 (2010).
Imangholi, B. Investigation of laser cooling in semiconductors PhD thesis, The University of New Mexico, (2006).
M. Liu, M. B. Johnston, H. J. Snaith, Nature 2013, 501, 395.
J. H. Heo, S. H. Im, J. H. Noh, T. N. Mandal, C. S. Lim, J. A. Chang, Y. H. Lee, H. J. Kim, A. Sarkar, M. K. Nazeeruddin, M. Grä tzel, S. I. Seok, Nat. Photonics 2013, 7, 486.
A. Kojima, K. Teshima, Y. Shirai, T. Miyasaka, J. Am. Chem. Soc. 2009, 131, 6050.
J. H. Noh, S. H. Im, J. H. Heo, T. N. Mandal, S. I. Seok, Nano Lett. 2013, 13, 1764.
L. Etgar, P. Gao, Z. S. Xue, Q. Peng, A. K. Chandiran, B. Liu, M. K. Nazeeruddin, M. Grätzel, J. Am. Chem. Soc. 2012, 134, 17 396.
B. Cai, Y. Xing, Z. Yang, W. H. Zhang, J. S. Qiu, Energy Environ. Sci. 2013, 6, 1480.
C. R. Kagan, D. B. Mitzi, C. D. Dimitrakopoulos, Science 1999, 286, 945.
K. Chondroudis, D. B. Mitzi, Chem. Mater. 1999, 11, 3028.
T. Hattori, T. Taira, M. Era, T. Tsutsui, S. Saito, Chem. Phys. Lett 1996, 254, 103.
L. C. Schmidt, A. Pertegas, S. G. Carrero, O. Malinkiewicz, S. Agouram, G. M. Espallargas, H. J. Bolink, R. E. Galian, J. P. Prieto, J. Am. Chem. Soc. 2014, 136, 850.
D. B. Mitzi, M. T. Prikas, K. Chondroudis, Chem. Mater. 1999, 11, 542.
K. Liang, D. B. Mitzi, M. T. Prikas, Chem. Mater. 1998, 10, 403.
J. Zhang, Z. Peng, A. Soni, Y. Y. Zhao, Y. Xiong, B. Peng, J. B. Wang, M. S. Dresselhaus, Q. H. Xiong, Nano Lett. 2011, 11, 2407.
N. Chen, S. H. Chen, C. B. Ouyang, Y. W. Yu, T. F. Liu, Y. J. Li, H. B. Liu, Y. L. Li, NPG Asia Mater. 2013, 5, 1.
P. Krogstrup, H. I. Jørgensen, M. Heiss, O. Demichel, J. V. Holm, M. Aagesen, J. Nygard, A. F. i Morral, Nat. Photonics 2013, 7, 306.
D. H. Li, J. Zhang, Q. H. Xiong, ACS Nano 2012, 6, 5283.
M. I. B. Utama, M. de la Mata, C. Magen, J. Arbiol, Q. H. Xiong, Adv. Funct. Mater. 2013, 23, 1636.
M. Gillet, R. Delaware, E. Gillet, J. Cryst. Growth 2005, 279, 93.
I. Matolinova, M. Gillet, E. Gillet, V. Matolin, Nanotechnology 2009, 20, 445 604.
Z. X. Wang, T. Kong, K. Zhang, H. L. Hu, X. P. Wang, J. G. Hou, J. Chen, Mater. Lett. 2007, 61, 251.
M. I. B. Utama, F. J. Belarre, C. Magen, B. Peng, J. Arbiol, Q. H. Xiong, Nano Lett. 2012, 12, 2146.
G. K. Kasi, N. R. Dollahon, T. S. Ahmadi, J. Phys. D: Appl. Phys. 2007, 40, 1778.
G. A. Ozin, Can. J. Chem. 1970, 48, 2931.
Q. Chen, H. Zhou, Z. Hong, S. Luo, H. S. Duan, H. H. Wang, Y. S. Liu, G. Li, Y. Yang, J. Am. Chem. Soc. 2014, 136, 622.
Z. Zheng, A. Liu, S. Wang, Y. Wang, Z. S. Li, W. M. Lau, L. Z. Zhang, J. Mater. Chem. 2005, 15, 4555.
M. R. Tubbs, Phys. Stat. Sol. 1972, 49, 11.
N. Kitazawa, Y. Watanabe, Y. Nakamura, J. Mater. Sci. 2002, 37, 3585.

(56) References Cited

OTHER PUBLICATIONS

K. Tanaka, T. Takahashi, T. Ban, T. Kondo, K. Uchid, N. Miura, Sol. Stat. Comm. 2003, 127, 619.

* cited by examiner

LASER COOLING OF ORGANIC-INORGANIC LEAD HALIDE PEROVSKITES

CROSS-REFERENCE TO RELATED APPLICATION

This application claims the benefit of priority of Singapore Patent Application No. 10201406791Q, filed Oct. 20, 2014, the contents of which being hereby incorporated by reference in its entirety for all purposes.

TECHNICAL FIELD

The invention relates generally to cooling matter using laser emission, and in particular, to cooling perovskite materials using laser emission.

BACKGROUND

Optical irradiation with suitable energy can cool solids, a phenomenon known as optical refrigeration proposed by Pringsheim in 1929. Since the first experimental breakthrough in ytterbium-doped glasses, considerable progress has been made in various rare-earth-element-doped materials, with a recent record of cooling to 114 K directly from ambient.

The main obstacle that hinders experimental observation of laser cooling for decades in semiconductors is the low luminescence extraction efficiency. GaAs, for instance, requires a minimum extraction efficiency of 20-30% at the optimal carrier density which is difficult to achieve due to its large refractive index. One possible solution to relax the extraction efficiency challenge is to find suitable materials which have very low non-radiative recombination rates.

While the toolbox of optical refrigeration is still limited, practical applications demand more suitable materials with scalable synthesis and high cooling power density.

Accordingly, there remains an unmet need to provide for suitable materials for integration with optical refrigeration devices.

SUMMARY

Present inventors have surprisingly found that perovskite materials exhibit strong photoluminescence upconversion and high external quantum efficiency due to an exceptionally low non-radiative recombination rate. In one disclosed embodiment, a record high ~50 K/mW net cooling in micrometer-sized $CH_3NH_3PbI_3$ perovskite crystals from room temperature has been demonstrated.

Considering the thin film processing compatibility and low crystallization temperature for this emergent family of perovskite materials, present findings advocate the considerable promise of solution-processed organic-inorganic perovskite thin films towards integrated optical refrigeration devices.

Accordingly, a first aspect of the disclosure relates to a laser cooling apparatus for cooling a sample. The apparatus comprises a laser for providing an emission. The apparatus further comprises a cold chamber adapted to provide or maintain a cold environment of 200 K or less to the sample positioned in the cold chamber. The apparatus further comprises the sample wherein the sample comprises a perovskite material.

According to a second aspect of the disclosure, there is disclosed a method for carrying out laser cooling to a sample. The method comprises positioning the sample in a cold chamber adapted to provide or maintain a cold environment of 200 K or less to the sample, wherein the sample comprises a perovskite material. The method further comprises irradiating the sample with a laser.

Preferably, the sample comprises an organic-inorganic lead halide perovskite material.

More preferably, the sample comprises $CH_3NH_3PbI_3$, $CH_3NH_3PbCl_3$, $CH_3NH_3PbBr_3$, $CH_3NH_3PbICl_2$, $CH_3NH_3PbIBr_2$, $CH_3NH_3PbClI_2$, $CH_3NH_3PbClBr_2$, $CH_3NH_3PbBrI_2$, $CH_3NH_3PbBrCl_2$, or $CH_3NH_3PbIClBr$.

In a specific embodiment, the sample comprises $CH_3NH_3PbI_3$.

Alternatively, the sample comprises $(C_6H_5CH_2CH_2NH_3)_2PbI_4$, $(C_6H_5CH_2CH_2NH_3)_2PbCl_4$, $(C_6H_5CH_2CH_2NH_3)_2PbBr_4$, $(C_6H_5CH_2CH_2NH_3)_2PbICl_3$, $(C_6H_5CH_2CH_2NH_3)_2PbICl_2Br$, $(C_6H_5CH_2CH_2NH_3)_2PbIClBr_2$, $(C_6H_5CH_2CH_2NH_3)_2PbIBr_3$, $(C_6H_5CH_2CH_2NH_3)_2PbIBr_2Cl$, $(C_6H_5CH_2CH_2NH_3)_2PbIBrCl_2$, $(C_6H_5CH_2CH_2NH_3)_2PbI_2Cl_2$, $(C_6H_5CH_2CH_2NH_3)_2PbI_2ClBr$, $(C_6H_5CH_2CH_2NH_3)_2PbI_2Br_2$, $(C_6H_5CH_2CH_2NH_3)_2PbI_3Cl$, or $(C_6H_5CH_2CH_2NH_3)_2PbI_3Br$.

In one alternative embodiment, the sample comprises $(C_6H_5CH_2CH_2NH_3)_2PbI_4$.

Preferably, the laser comprises a tunable wavelength.

More preferably, the laser comprises a tunable wavelength of between 750 and 850 nm.

Preferably, the cold chamber comprises a cryostat. It is generally known that a cryostat is a device used to maintain low (cryogenic) temperatures of samples or devices mounted within the cryostat.

BRIEF DESCRIPTION OF THE DRAWINGS

In the drawings, like reference characters generally refer to the same parts throughout the different views. The drawings are not necessarily drawn to scale, emphasis instead generally being placed upon illustrating the principles of various embodiments. In the following description, various embodiments of the invention are described with reference to the following drawings.

DESCRIPTION

The following detailed description refers to the accompanying drawings that show, by way of illustration, specific details and embodiments in which the invention may be practised. These embodiments are described in sufficient detail to enable those skilled in the art to practise the invention. Other embodiments may be utilized and structural, logical, and electrical changes may be made without departing from the scope of the invention. The various embodiments are not necessarily mutually exclusive, as some embodiments can be combined with one or more other embodiments to form new embodiments.

It is known that perovskites exhibit extremely low non-radiative recombination rate and high external quantum efficiency. These two properties are extremely advantageous for laser cooling if a sufficient photoluminescence upconversion could be achieved. To prove this point, present inventors have demonstrated that lead triiodide ($CH_3NH_3PbI_3$) perovskite crystals (as one example of suitable perovskite material) showed a strong photoluminescence upconversion and the $CH_3NH_3PbI_3$ crystals can be laser cooled by 50 K/mW from room temperature pumped by near infrared lasers.

Figure 1:
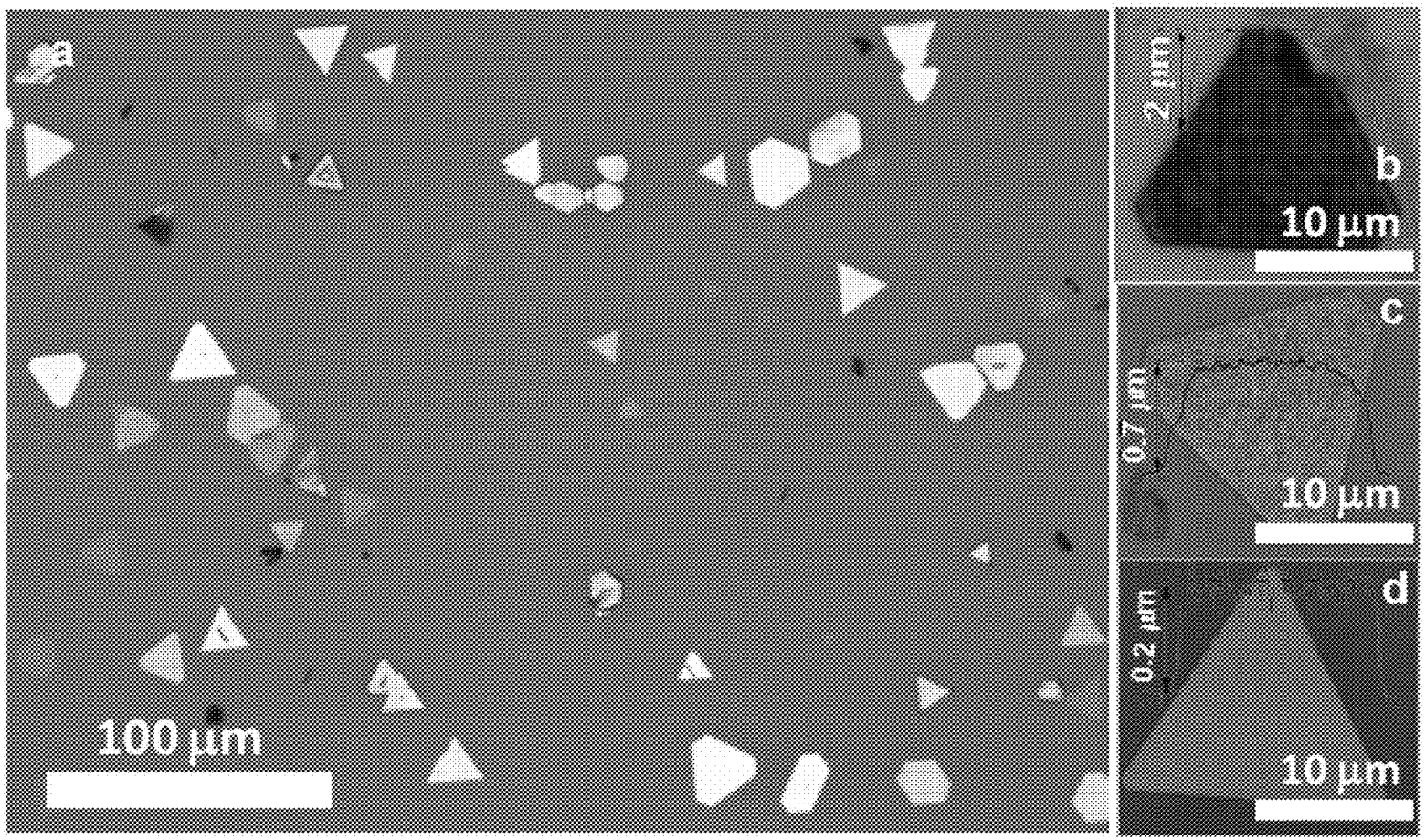
FIG. 1 shows an optical image of as-synthesized perovskite nano-platelets on muscovite mica. (a) Optical image of as-grown sample on mica, (b)-(d) thickness profile of typical platelets used for laser cooling experiments.

FIG. 1(*a*) shows an optical image of $CH_3NH_3PbI_3$ perovskite crystals in platelet morphology on muscovite mica substrates prepared by a chemical vapor deposition (CVD) approach to be described in later paragraphs. The crystalline platelets exhibit tens of micrometers in size, with a thickness varied from tens of nanometers to a few micrometers. The difference in color of platelets originates from their difference in thickness, which can be accurately determined by atomic force microscopy (AFM) and profilometry. FIG. 1(*b*)-(*d*) display the optical images of three typical platelets with the sectional profiles embedded, indicating the corresponding thicknesses. The perovskite platelets synthesized by this method exhibit good crystallinity with a tetragonal phase at room temperature.

Figure 2:
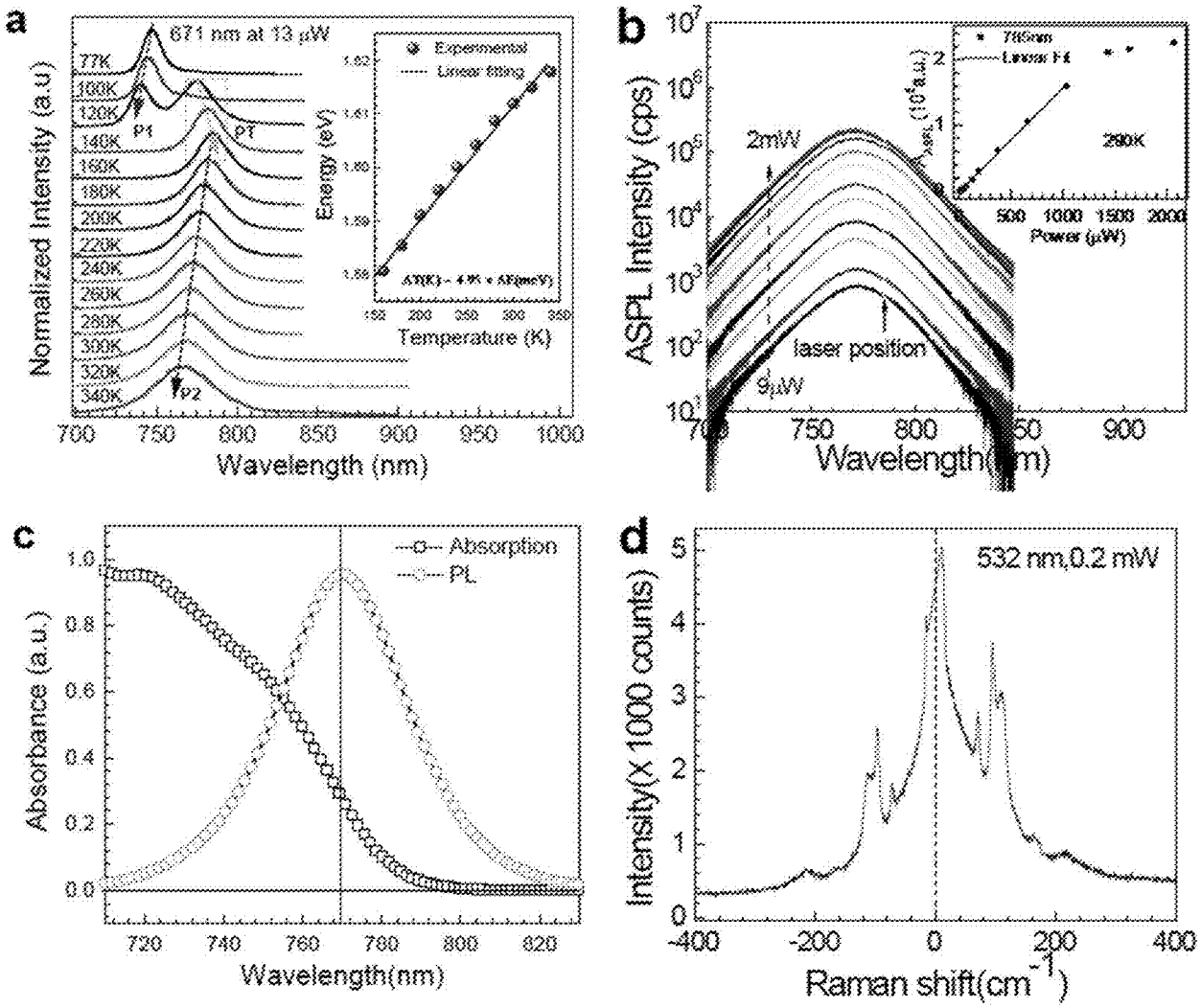
FIG. 2 shows optical characterizations of $CH_3NH_3PbI_3$ nano-platelet. (a) Normalized photoluminescence from 77K to 340K, excited by 671 nm laser at 13 μW. The inset is a temperature calibration curve based on the emission peaks. (b) Power dependence of anti-Stokes photoluminescence pumped by 785 nm laser at 294 K. Inset: intensity versus pump power extracted from (a). Below ~1 mW, the intensity scales linearly with power indicating a phonon-assisted upconversion. (c) Photoluminescence excited by 671 nm laser and the absorption spectrum obtained from the van Roosbroeck-Shockley relationship. (d) Room temperature Raman spectrum, excited by a 0.2 mW 532 nm laser.

FIG. 2(*a*) shows the temperature dependent photoluminescence spectra of a perovskite platelet from 77 K to 340 K, excited by a 671 nm laser with a low power of ~13 μW to minimize the heating effect. It is known that $CH_3NH_3PbI_3$ has orthorhombic-to-tetragonal phase transition at around 150 K. Present experimental results show that below 120 K, the photoluminescence peak at ~750 nm can be assigned to orthorhombic phase. From 120 K to 160 K, the perovskite exhibits a phase transition which leads to the appearance of a lower energy peak at ~780 nm (dashed box). Above 160 K, only one photoluminescence peak at ~780 nm could be observed which corresponds to the tetragonal phase. From 160 K to 340 K, as temperature increases the PL peak linearly blue-shifts as illustrated in the inset to FIG. 2(*a*). Based on this relationship, a temperature calibration curve can be obtained: $\Delta T$ (K)=4.95×$\Delta E$ (meV), relative to the band edge emission at room temperature. It is important to note that the photoluminescence shift of the perovskite is in opposite trend compared to conventional semiconductors, which was attributed to abnormal electron-phonon interactions.

Next, the inventors investigate the intensity of the anti-stoke photoluminescence (ASPL) versus laser power (FIG. 2(*b*), plotted in logarithmic scale for clarity). Below 1000 μW, the ASPL intensity linearly depends on laser power indicating that phonon-assisted upconversion process dominates. Above this power, ASPL intensity saturates and even decreases if the laser irradiation sustains for a while, due to possible degradation at a high laser power. FIG. 2(*c*) displays the Stokes photoluminescence (red curve) taken at 290 K and the corresponding absorption spectra obtained from the van Roosbroeck-Shockley relation (black curve). The photoluminescence peak is at ~770 nm, in good agreement with other reports. As moving to the band tail, the absorption decreases and reaches zero at ~815 nm indicating that there should be no substantial upconversion photoluminescence beyond this wavelength. FIG. 2(*d*) displays the Stoke and anti-Stoke Raman spectra of the perovskite platelet excited by a 532 nm laser. It can be seen that $CH_3NH_3PbI_3$ exhibits rich low-energy phonons (<110 $cm^{-1}$), advantageous for suppressing multi-phonon relaxation pathways towards higher laser cooling performance as discussed in rare-earth element doped glasses and crystals.

Figure 3:
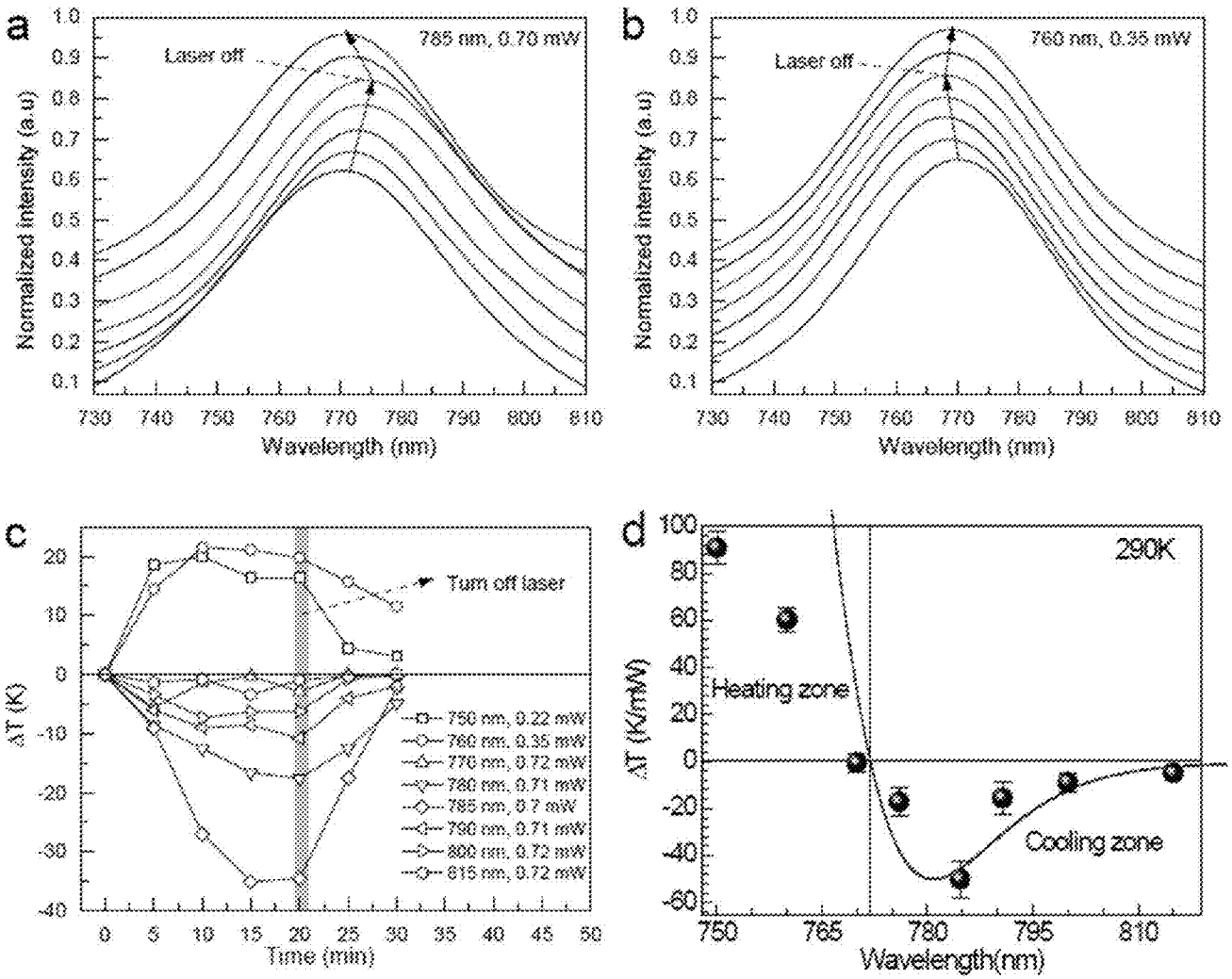
FIG. 3 shows net laser cooling of $CH_3NH_3PbI_3$ nano-platelets. (a) Evolution of PPLT spectra starting from 290 K, pumped by a 785 nm laser with a power of 0.7 mW. (b) Evolution of PPLT spectra starting from 290 K, pumped by a 760 nm laser with a power of 0.35 mW. (c) Temperature change versus time pumped by eight laser lines (815, 800, 790, 785, 780, 770, 760, and 750 nm), using data extracted from the PPLT spectra. (d) Summary of measured maximum ΔT (black dots) and theoretically calculated temperature change (black curve) normalized to pump power for different pump wavelengths at 290 K.

To measure the cooling effect of the platelets, the inventors adopt a pump-probe luminescence thermometry (PPLT) technique, details of which will be described in later paragraphs. The mica substrate (less than 100 μm) having perovskite platelets was suspended to isolate the sample from the cold finger of the cryostat. Mica exhibits excellent transparency (>95% for 100 μm thick film at 770 nm), low refractive index (~1.6) and thermal conductivity (~0.35 W/m.K). Therefore, this design reduces the background absorption, increase the luminescence extraction efficiency and reduce the thermal load during cooling experiment. FIG. 3(*a*) and FIG. 3(*b*) display the evolution of photoluminescence spectra for two representative cooling and heating pumped at 785 nm and 760 nm, respectively. It is clearly seen that the photoluminescence red-shifts pumped by 785 nm, indicating a cooling process in the perovskite platelet (refers to the calibration curve shown in the inset to FIG. 2(*a*)).

Figure 8:
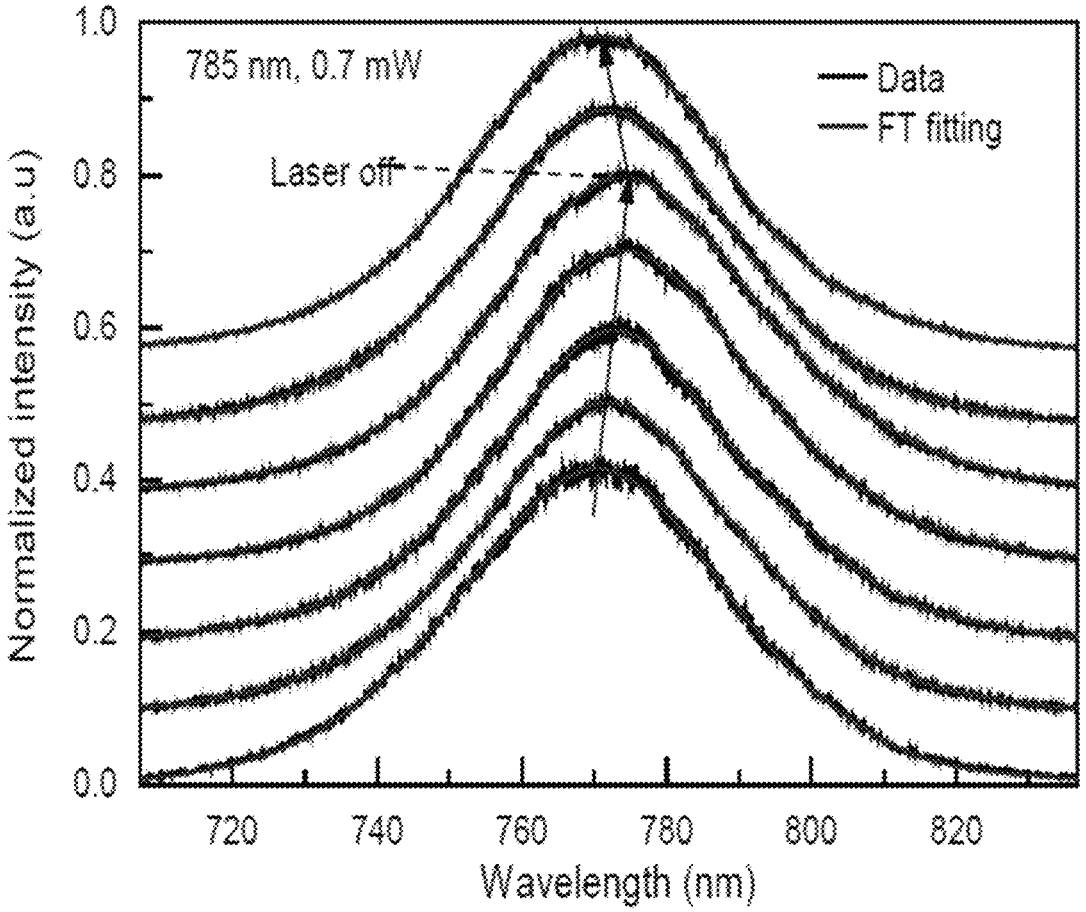
FIG. 8 shows fitting of PPLT spectra. The spectra were taken during the cooling experiment with excitation wavelength of 785 nm and a power of 0.7 mW. The spectra have been shifted vertically for clarity.
Figure 9:
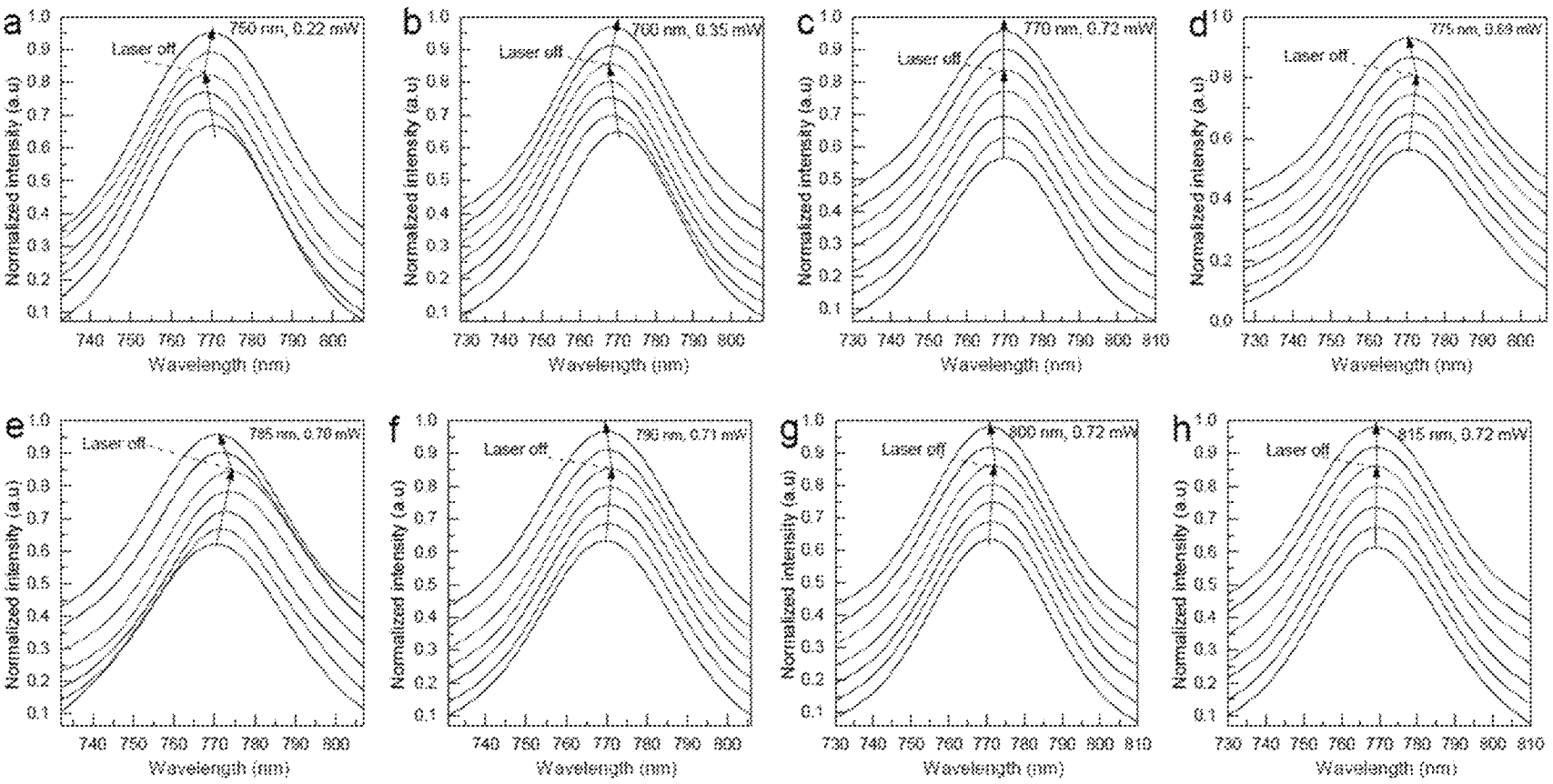
FIG. 9 shows PPLT spectra taken in every 5 minutes interval for eight different laser pumping at 290 K. Excitation below the bandgap (770 nm) leads to heating of sample as seen in (a) and (b) for 750 and 760 nm, respectively. Excitation at the bandgap and at the end of Urbach tail leads to no change in temperature as seen in (b) (770 nm) and (h) (815 nm). All other wavelength excitations (d)-(g) lead to cooling of sample. The spectra have been shifted vertically for clarity.

On the contrary, 760 nm pumping leads to blue-shifted band edge, indicating a heating process. After the pump lasers were turned off, the photoluminescence spectra returned to their original position indicating that the cooling-warming cycle is reversible. A summary of series cooling and heating experiments with different pumping wavelengths is shown in FIG. 3(*c*), while the processing and the full spectra for various temperatures are shown in FIGS. 8 and 9, to be described in later paragraphs. The data show that the perovskite platelet could be cooled by a maximum of 35 K from room temperature pumped by 785 nm with a power of 0.7 mW, from the exact sample with a thickness of 2.0 μm shown in FIG. 1(*b*). The normalized cooling power density (in K/mW) is plotted in FIG. 3(*d*), showing a maximum cooling effect ~50 K/mW around 785 nm. The solid curve is a theoretical calculation based on Sheik-Bahae-Epstein (SB-E) theory showing a reasonable agreement, except for the heating points (at 750 and 760 nm).

To understand the excellent laser cooling properties in perovskite crystals, the SB-E theory describes the net cooling power $P_{net}$ in the semiconductor as:

$$P_{net}=\eta_e BN^2(h\nu-h\bar{\nu}_f)+ANh\nu+CN^3h\nu+\Delta P \quad (1)$$

where $\eta_e$ is the extraction efficiency of the photoluminescence, N is the photo-excited electron-hole carrier density; A, B, C are the recombination coefficients of non-radiative (one particle), radiative (two particle), and Auger (three particle) processes, respectively; vand $\bar{\nu}_f$ are excitation and mean emission luminescence photon frequency, respectively; and ΔP is a residual heating term accounting for free-carrier absorption and other parasitic absorptive processes, $\Delta P=\alpha_b I+\sigma_{fca}NI$, where $\alpha_b$ is the background absorption and $\sigma_{fca}$ is the free-carrier absorption cross section and I is the laser irradiance intensity. When the excitation occurs near the band-edge, the interband absorption dominates and thus the term ΔP can be ignored.

Then, the cooling efficiency could be expressed as:

$$\eta_c = \eta_i \frac{\bar{\nu}_f}{\nu} - l = \left(\frac{\eta_e BN^2}{AN + \eta_e BN^2 + CN^2}\right)\frac{\bar{\nu}_f}{\nu} - 1, \quad (2)$$

here $$\eta_i = \frac{\eta_e BN^2}{AN + \eta_e BN^2 + CN^2}$$

represents the external quantum efficiency. The cooling is possible when $\eta_c$ is positive. The above phenomenological theory considers only free electron model, more discussions including excitonic effect, band-tail states and surface plasmon assisted laser cooling can be found in literature.

Figure 4:
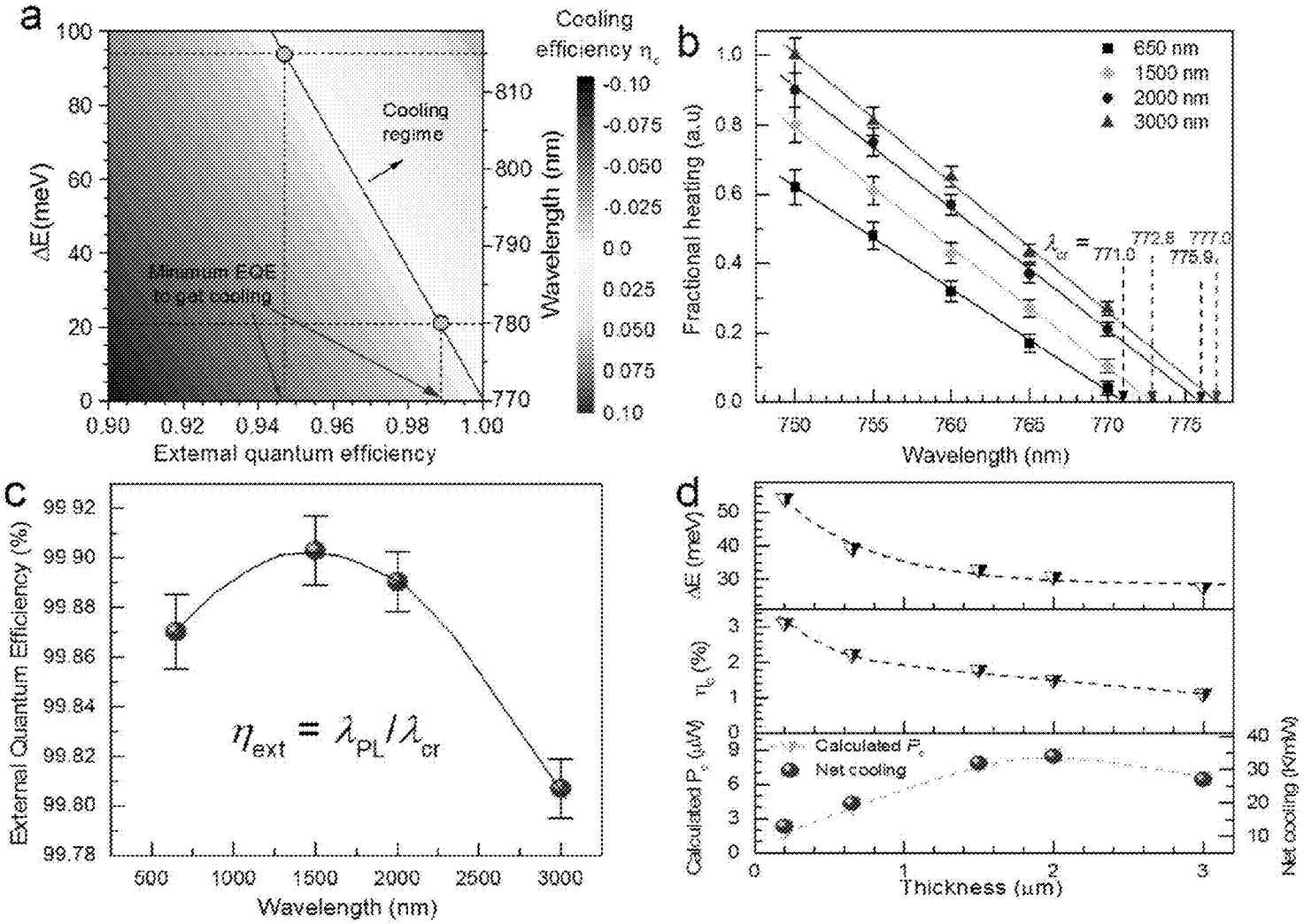
FIG. 4 shows the condition for laser cooling in $CH_3NH_3PbI_3$ perovskite. (a) Calculated cooling efficiency as a function of external quantum efficiency and energy difference between the excitation photon and emission photon energies. (b) The fractional heating at various wavelength excitations for four different thicknesses is shown. (c) Determination of maximum charge carrier density where cooling is possible for $CH_3NH_3PbI_3$. Inset: zoom-in of external quantum efficiency from 0.9 to 1. (d) Thickness dependent laser cooling of perovskite platelets for 785 nm wavelength excitation at 0.7 mW. Dashed lines are shown as guide to eye.

Based on equation (2), the inventors plot the cooling efficiency as a function of external quantum efficiency $\eta_i$ and $\Delta E=h\bar{\nu}_f-h\nu$ for $CH_3NH_3PbI_3$ (band edge of 770 nm) shown in FIG. 4(*a*). As can be seen from FIG. 4(*a*), a minimal $\eta_i$ of ~0.95 and ~0.98 are required for excitation at 815 nm (ΔE=95 meV) and 785 nm (ΔE=32 meV), respectively, as indicated by the dashed lines. The cooling efficiency increases as the $\eta_i$ approaches unity. The calculation is valid only when the background and free-carrier absorption are negligible. As the excitation photon energy moves into the Urbach tail (i.e. large ΔE), the interband absorption reduces dramatically and thus the background and free carrier absorption are no longer negligible.

The external quantum efficiency of the perovskite platelets was then determined by using a bolometric calibration method which has been described in literature to measure external quantum efficiency of GaAs. The experimental setup is similar to the present laser cooling experiment described above. Various laser wavelengths with energies higher than that of the mean emission PL of perovskite platelets were used to pump and record the temperature change in the samples. The excitation power for different wavelengths was adjusted so that the emission PL intensity in each experiment is comparable. This is to ensure that the total emitted photons for each wavelength are constant considering the PL collection efficiency of present optical system remained unchanged in all measurement. In addition, the excitation powers should be kept low enough (i.e., <0.1 mW) to avoid heating of sample which may affect the local the temperature. FIG. 4(*b*) shows the fractional heating at various wavelength excitations for four different thicknesses. From this result, the $\lambda_{cr}$ which is the intersection between the linear fit of the fractional heating at different wavelength and the x-axis can be determined. This was then used to calculate the external quantum efficiency of the perovskite platelet as shown in FIG. 4(*c*). As shown in FIG. 4(*c*), the external quantum efficiency is extremely high for those perovskite platelets and reaches maximum at the thickness around 1.5 μm. This high value of external quantum efficiency (i.e. ~99.8%) explains why net laser cooling even with excitation wavelength at 780 nm where the minimal external quantum efficiency required for cooling is 99% could be observed (FIG. 4(*a*)).

Figure 11:
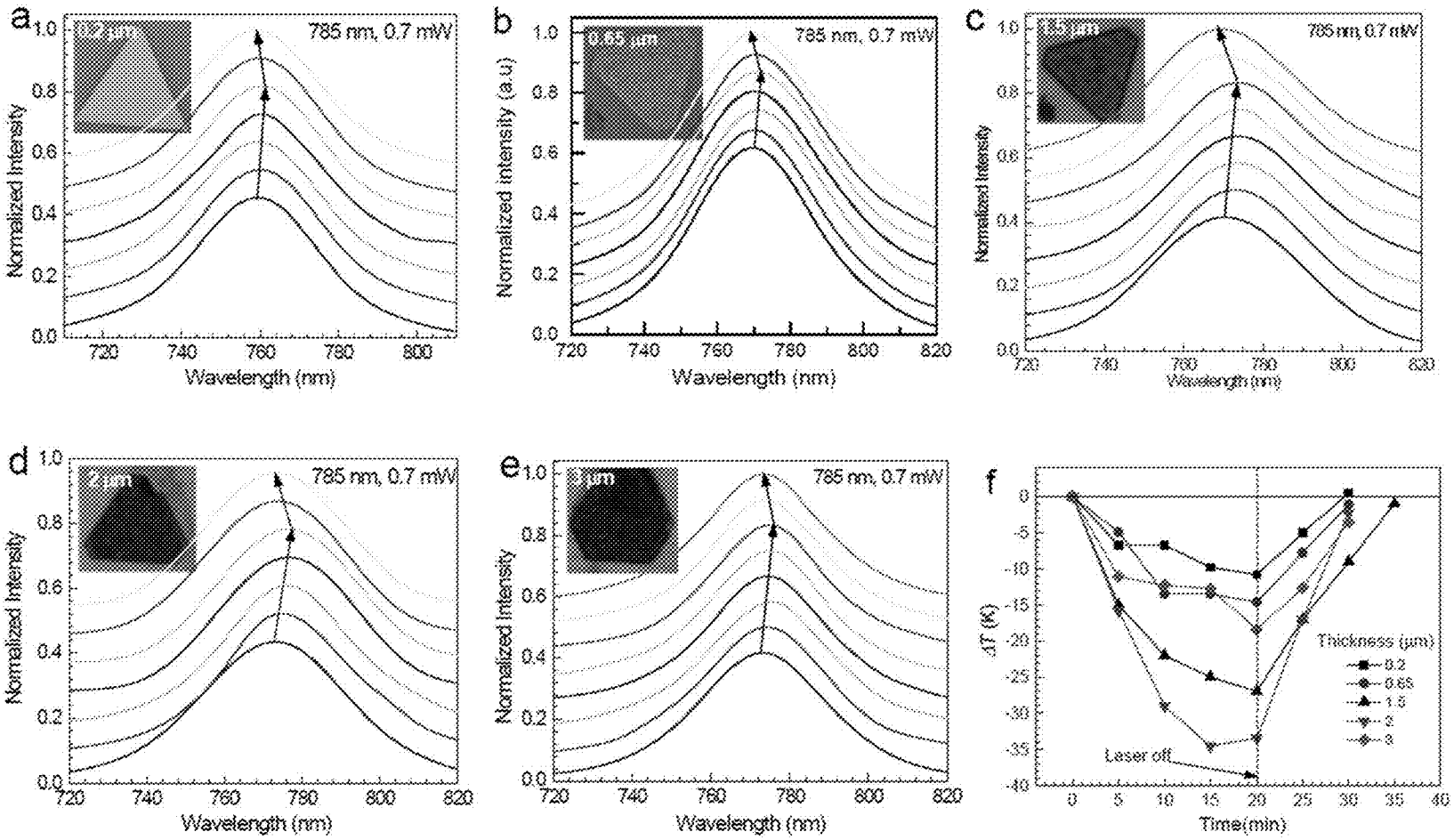
FIG. 11 shows laser cooling of $CH_3NH_3PbI_3$ platelets with different thickness. (a)-(e) PPLT spectra taken every 5 minutes interval during cooling experiment for platelets with different thickness. Excitation pumping wavelength is 785 nm for all samples. The pumping laser was turned off after 20 minutes. (f) Summary of cooling results for platelets with different thicknesses.
Figure 12:
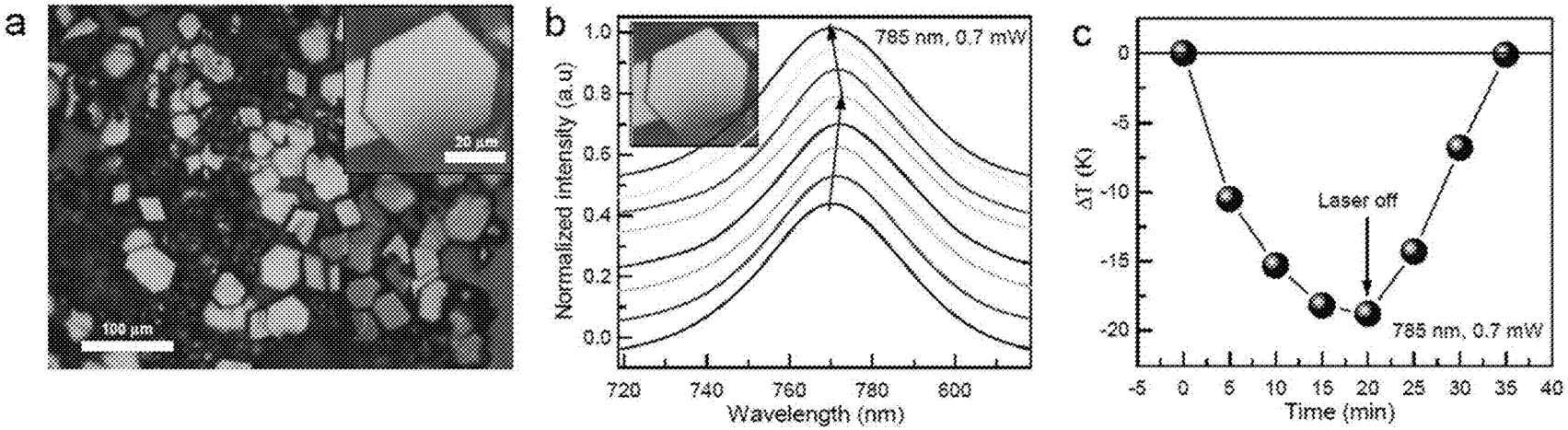
FIG. 12 shows laser cooling of solution-processed perovskite crystal. (a) Optical image of $CH_3NH_3PbI_3$ perovskite crystal grown by drop-casting on muscovite mica substrate. Inset: Zoom-in image of a single crystal. (b) PPLT spectra taken every 5 minutes during cooling experiment with 785 nm excitation at 0.7 mW. (c) Temperature change with time extracted from PPLT spectra in (b).

To further elaborate this, the inventors conducted thickness-dependent cooling on a variety of platelet crystals. FIG. 4(*d*) summarizes the thickness dependent ΔE (upper panel), calculated cooling efficiency (middle panel) and calculated cooling power by the 785 nm excitation (lower panel). The cooling power of perovskite platelets with different thicknesses was estimated based on the actual absorption measured. It is noted that the trend of the calculated cooling power versus thickness agrees with the experimental values in K/mW. The maximal cooling of 8.8 μW can be achieved at a thickness ~2 μm in agreement with present experimental observation as well (FIG. 11). The estimated blackbody radiation is ~2.0 nW, therefore the thermal conductive heat dissipation dominates. Similar laser cooling measurements were conducted on solution-processed thin crystals on mica (FIG. 12). The result shows that a net cooling of ~20 K can be readily obtained which opens up possibility to scale up the material synthesis towards a practical optical refrigeration device. It is important to note that polycrystalline thin film prepared by spin-casting method cannot tolerate similar pump power, leading to degradation rapidly. Furthermore, it has been observed that a few other halide compounds in the perovskite family $CH_3NH_3PbX_3$ (X=Cl, Br, I, and their combinations) show strong upconversion photoluminescence (FIG. 13), which suggests considerable promises in expanding the laser cooling toolbox, and for the optimizing and accomplishing higher net cooling in those materials.

Present work dramatically expands the toolbox for optical refrigeration, considering the numerous combinations of inorganic-organic perovskites. With the facile solution processing and accessible crystallization temperature of those perovskite materials, present work opens up the possibility of practical optical refrigeration for electronic and optoelectronic devices. The remaining challenge is to scale up the current vapor phase or solution synthesis towards a uniform macroscale crystalline film, which shows much better stability under continuous laser pumping than those polycrystalline films that are usually used in solar cell applications.

Sample Preparation Method

The synthesis of perovskite platelets was carried out in a home-built chemical vapor deposition (CVD) system. The method has been published elsewhere.

Synthesis of lead halide platelets: Source materials $PbI_2$, $PbBr_2$, or $PbCl_2$ powder (99.999%, Aldrich) were used as a single source and put into a quartz tube mounted on a single zone furnace (Lindberg/Blue M TF55035C-1). The freshly-cleaved muscovite mica substrate (1×3 $cm^2$) was pre-cleaned by acetone and placed in the downstream region inside the quartz tube. The quartz tube was first evacuated to a base pressure of 2 mTorr, followed by a 30 sccm flow of high purity Ar gas premixed with 5% $H_2$ gas. The temperature and pressure inside the quartz tube were set and stabilized to desired values for each halide (380° C. and 200 Torr for $PbI_2$; 350° C. and 75 Torr for $PbBr_2$; and 510° C. and 200 Torr for $PbCl_2$). In all cases, the synthesis was done within 20 minutes and the furnace was allowed to cool down to ambient temperature naturally.

Figure 5:
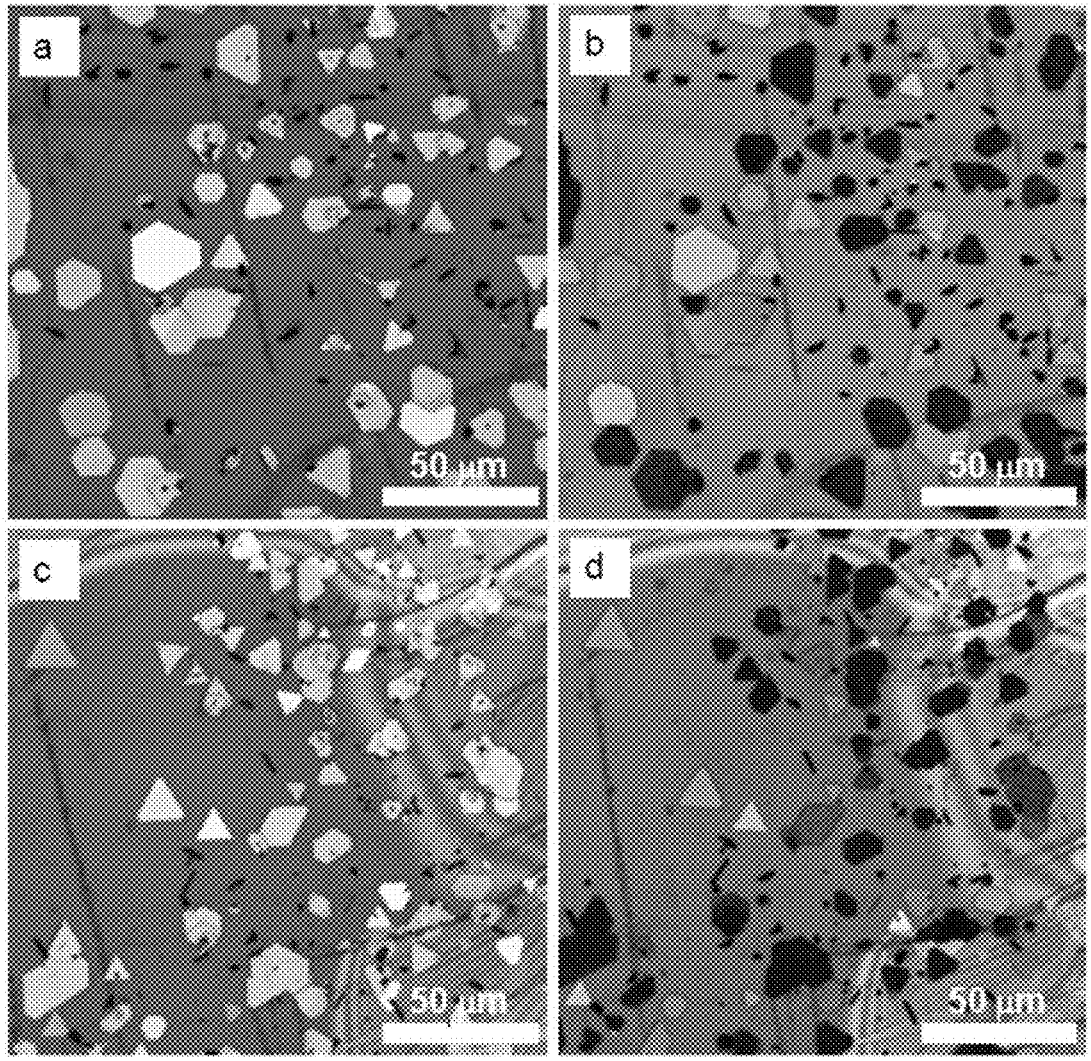
FIG. 5 shows optical images of lead iodide platelets on muscovite mica (a, c) and their corresponding lead triiodide perovskite platelets after conversion (b, d). The change in color of platelets was due to the increasing of thickness after conversion.

Conversion of lead halides to perovskites: The conversions were also conducted in the same CVD reactor. Methyl ammonium halides synthesized by solution method were used as a source and placed in the center of the quartz tube while mica substrates having as-grown lead halide platelets were placed around 5-6 cm away from the center in the downstream region. The quartz tube was first evacuated to a base pressure of 2 mTorr, followed by a 30 sccm flow of high purity Ar or $N_2$ gas. The pressure was then stabilized at 50 Torr and temperature was elevated to 120° C. and kept for 1 hour and the furnace was allowed to cool down to ambient temperature naturally. The optical images of as-prepared lead-triiodide perovskite platelets on muscovite mica are shown in FIG. 5. The color difference is originated from the thickness difference.

Anti-Stokes PL Decreasing after Long Time Irradiating at High Power

Figure 6:
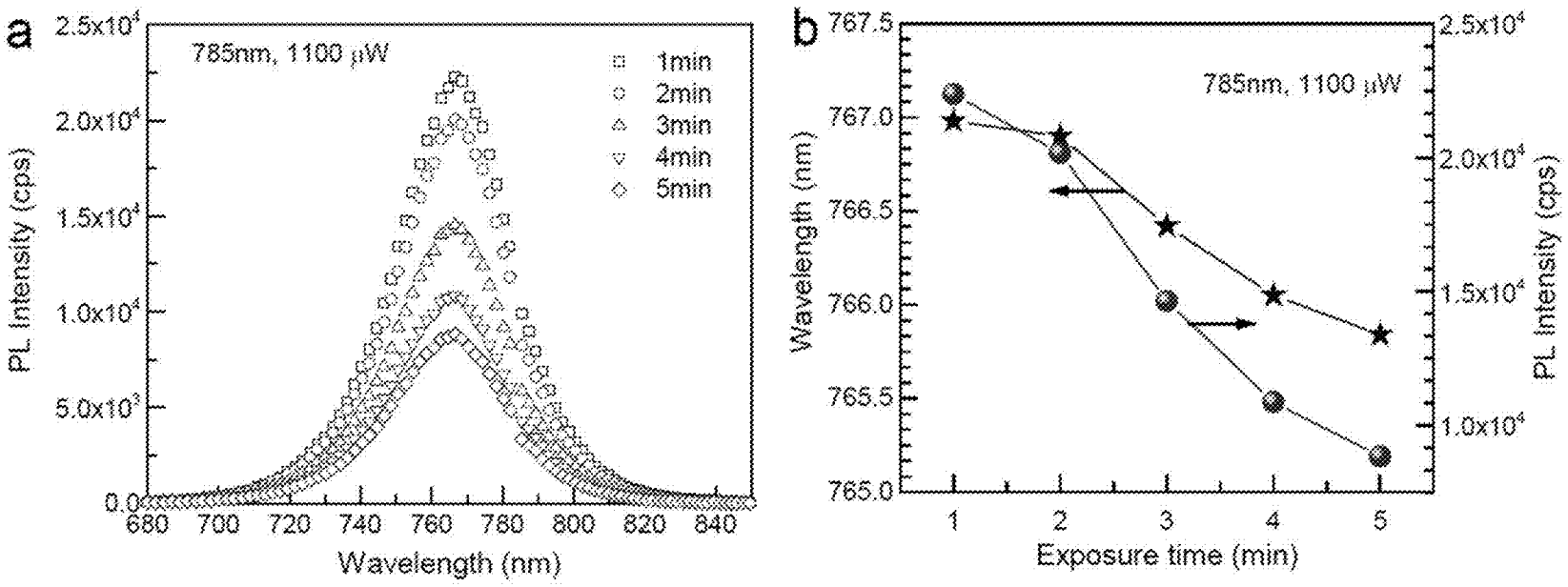
FIG. 6 shows degradation of perovskite platelets under high power irradiation. (a) Anti-Stokes photoluminescence spectra of perovskite platelet with the excitation wavelength of 785 nm at 1100 μW taken every 1 minute while continuously pumping. (b) The evolution of anti-Stokes luminescence intensity and peak position extracted from spectra from (a) showing a degradation of the sample.

As discussed with reference to FIG. 2(*b*) in earlier paragraphs, below 1000 μW at the excitation wavelength of 785 nm, the anti-Stokes luminescence intensity is linearly dependent on the excitation power. On the other hand, above that power, the anti-Stokes luminescence intensity seems to saturate. It is suspected that the sample may degrade due to the intrinsic instability of the perovskite under laser illumination. FIG. 6 shows the anti-Stokes luminescence spectra taken every 1 minute while the sample was continuously illuminated by 785 nm laser with a relatively high power of 1.1 mW. As can be seen, the intensity of anti-Stokes luminescence keeps decreasing as the illumination time increases. In addition, the luminescence peak position is also blue-shifted indicating the increasing of local temperature in the sample. This verifies that under long-time illumination at a high power, the sample degrades due to the heat load of the laser irradiation. In fact, the material was previously reported to be possibly degraded to lead iodide and ammonium iodide at the temperature higher than 100° C. Nevertheless, present cooling experiments were all carried out at the power around 0.7 mW at which the perovskite platelet was observed to be stable.

Temperature Determination

To precisely determine the local temperature at the sample upon laser cooling, the inventors adopt a pump-probe luminescence thermometry (PPLT) technology, which is based on the sensitivity of the luminescence peak shifts when the local temperature of sample is changed. This technique is believed to be equivalent to the differential luminescence thermometry and is suitable if the cooling effect is significant. Generally speaking, the luminescence peak of a semiconductor is blue (red) shifted when temperature decreases (increases). However, for perovskite material, the luminescence peak-shifting is in opposite trend with conventional semiconductors. The phenomenon has been observed by many groups for different perovskites, which is believed to be due to abnormal electron-phonon interaction. The inventors also observed similar trend for $CH_3NH_3PbI_3$ perovskite.

Nevertheless, for a temperature range from 160 to 330 K, the luminescence peak of the perovskite is linearly dependent on temperature which can be used as a calibration for the temperature determination (inset to FIG. 6(*a*)).

Pump-Probe Luminescence Thermometry Setup

Figure 7:
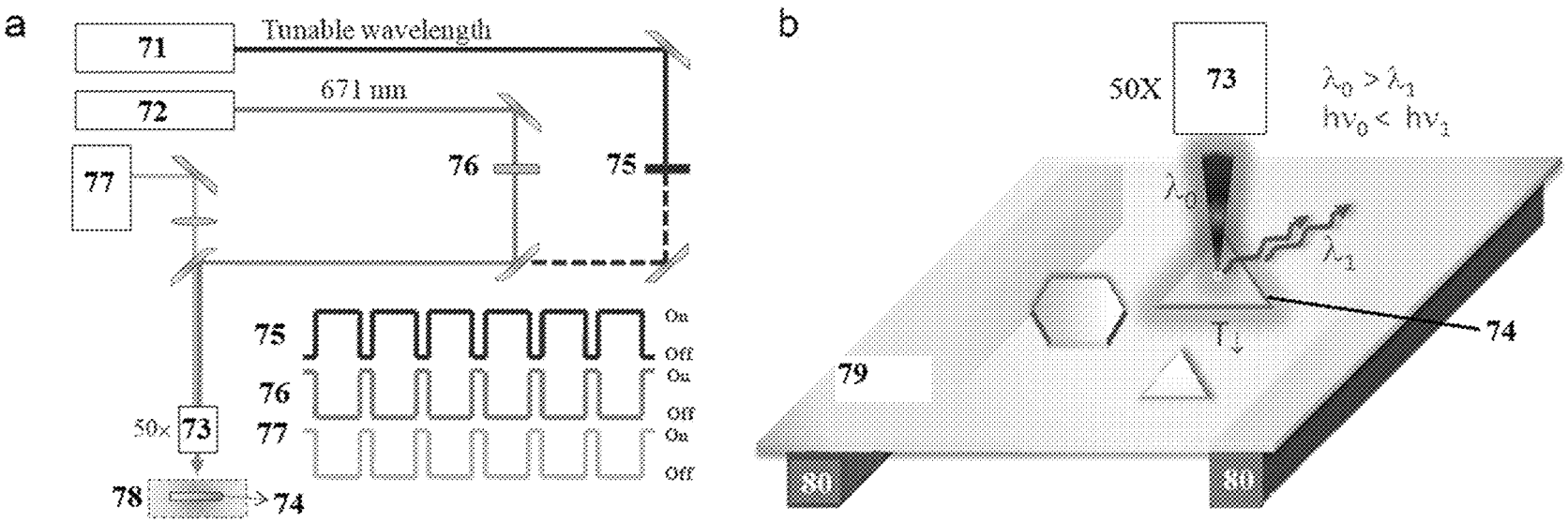
FIG. 7 shows (a) PPLT technique setup in laser cooling experiment; (b) a schematic diagram of the sample setup. Mica substrate is supported over two silicon pieces in order to further isolate sample from thermal dissipation. Then, whole sample is placed inside a cryostat which is vacuumed to $1\times10^{-6}$ Torr.

The pump-probe luminescence thermometry setup in present cooling experiment is shown in FIG. 7(*a*). A cw Ti-sapphire laser 71 with a tunable wavelength from 750 to 850 nm was used to pump in heating and cooling experiment while a solid state 671 nm laser 72 was used as a probe beam to measure the Stokes photoluminescence emission. The two lasers were collimated and focused thorough a 50× objective 73 onto a single perovskite platelet sample 74 placed in a cryostat 78. The shutter 75 and 76 were alternatively shut or opened to allow the transmission of the pump or probe lasers 71, 72. In present cooling and heating experiments, after pumping for every 5 minutes, the shutter 75 was blocked and 76 was opened and the photoluminescence spectra were collected by a confocal triple grating spectrometer (Horiba-JY T64000) in a backscattering configuration using a liquid nitrogen cooled charge-coupled CCD detector 77. In order to prevent the heating effect of 671 nm laser 72, the power was kept as low as 13 μW at a collection integrating time of 1 second. The total time to obtain one PPLT spectrum is around 1 minute due to the time needed for spectrometer to move the gratings to cover the whole wavelength regime of interest.

The actual cooling setup was schematically shown in FIG. 7(*b*). The mica substrate 79 (with the platelets 74) was peeled to be roughly 100 μm thin and was suspended between two supporters to minimize the thermal loss to the copper cold finger of the cryostat 78. Cryostat 78 was maintained at ~$10^{-6}$ Torr during the experiment. The size of the beam spot on the sample is ~5×5 $\mu m^2$, which corresponds to a confocal pinhole of ~500×500 $\mu m^2$ for the total signal throughput.

Fourier Transform of PPLT Spectra for Clarity

Multiple time average was not used to remove the low frequency noise in order to probe the temperature change rapidly. Instead, the inventors have used a short time of acquisition (1 second) and the Fourier transform (FT) to fit the luminescence data and remove the low frequency noise. FIG. 8 shows a typical fitting for PPLT spectra in present cooling experiment. As can be seen, the processing represents well the luminescence spectra and accurately presents the peak positions. Hereafter, the inventors use the processed spectra to present current data for clarity in the disclosure.

PPLT Spectra Evolution in Cooling and Heating Experiment

For clarity, only representative PPLT evolution data for 760 nm and 785 nm were shown in FIGS. 3(*a*) and 3(*b*). The summary plots of ΔT in FIG. 3(*c*) are actually extracted from a series of laser cooling measurements. The detailed data plotted as the probe Stokes PL spectra evolution taken in every 5 minutes for eight different wavelengths (750, 760, 770, 775, 785, 790, 800 and 815 nm) are shown in FIG. 9. As can be seen from whether the PL is blue-shifted or red-shifted upon laser pumping, the inventors can unambiguously identify that 775, 785, 790, 800 nm excitation lead to cooling of sample; 750 and 760 nm excitation lead to heating of sample. Meanwhile, 770 and 815 nm excitation lead to almost no change in temperature of sample. The cooling is only possible when ΔE is positive. Since the mean emission luminescence of the perovskite is around 770 nm, it can be expected that excitation by a wavelength lower than 770 nm leads to heating of sample, while higher wavelength excitation may possibly lead to cooling. In fact, present observation is in good agreement with the difference in ΔE in term of cooling and heating effect. As discussed in earlier paragraphs, as the excitation photon energy moves into the Urbach tail (i.e., large ΔE), the interband absorption reduces dramatically and thus the background and free carrier absorption are no longer negligible. Both the background and free carrier absorption lead to heating of material and therefore, reduce the cooling effect. In present experiment, when the inventors increase the excitation wavelength from 785 nm to 815 nm, the cooling effect was reduced. At 815 nm, almost no net cooling was achieved. The maximal cooling effect was achieved with the excitation wavelength around 785 nm. This trend is in good agreement with present theoretical estimation based on SB-E model as demonstrated in FIG. 3(*d*).

Thickness Dependent Cooling of Perovskite Platelets

Figure 10:
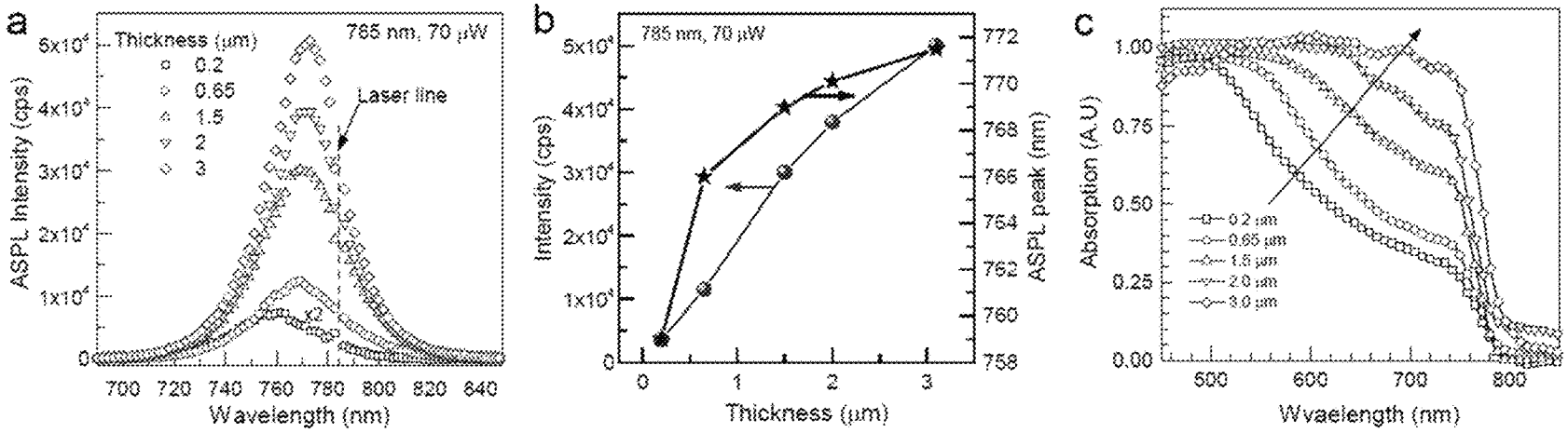
FIG. 10 shows anti-Stokes luminescence dependence on thickness of perovskite platelets. (a) ASPL spectra of perovskite platelets at different thickness. The excitation wavelength and power are 785 nm and 70 μW, respectively. (b) Mean emission luminescence peak position and intensity dependence on thickness extracted from (a). (c) Absorption spectra of individual platelets with different thickness measured by microspectrometer (CRAIC-20).

Mean Emission Anti-Stokes Luminescence of Perovskite Platelets at Different Thickness FIG. 10 shows anti-Stokes photoluminescence spectra of perovskite platelets with different thicknesses. As seen from FIG. 10(*b*), the mean emission luminescence peak red-shifts as thickness increases. The absorption spectrum of individual platelets reveals that the band edges are nearly the same with different thicknesses (FIG. 10(*c*)). Therefore, the mean emission luminescence peak shift is not due to the difference in band edge but may stem from other reasons such as surface depletion which should be further studied. Nevertheless, based on the data, ΔE of different thickness regard to excitation wavelength 785 nm can be calculated as shown in FIG. 4(*d*).

Cooling Results for Perovskite Platelets with Different Thickness

FIG. 11 shows the PPLT spectra taken during cooling experiments for perovskite platelets with different thicknesses from 200 nm to 3 μm with a 785 nm wavelength excitation. The lateral size of those platelets is around 20-30 μm. The maximal cooling of 35 K from room temperature was achieved on 2 μm platelet which agrees well with the calculated cooling power as shown in FIG. 4(*d*). The complete summary of cooling results is shown in FIG. 11(*f*).

Estimation of Cooling Efficiency and Cooling Power

Cooling efficiency was calculated by the equation:

$$\eta_c(\nu, T) = \eta_{ext}\frac{\overline{\nu}_f(T)}{\nu} - 1, \quad \text{(S-1)}$$

where $\eta_{ext}$ is the external quantum efficiency, $\overline{\nu}_f$ (T) is the mean emission luminescence frequency and ν is excitation wavelength frequency. Cooling power was calculated by the equation:

$$P_c = \eta_c \times \alpha(\nu) \times t \times P_0 \quad \text{(S-2)},$$

where $\eta_c$ is cooling efficiency, α is absorption coefficient at excitation wavelength, in this case $\alpha(785\text{ nm}) = 4\times10^3\text{ cm}^{-1}$ (FIG. 10 *c*). t is the absorption depth, $P_0$ is pumping power, in this case, $P_0$=0.7 mW. The penetration depth for 785 nm wavelength was estimated to be $d = 1/\alpha(785\text{ nm}) \approx 2.5$ μm. Thus, the absorption depth for samples thinner than the penetration depth will be equal to the thickness of sample while sample thicker than the penetration depth will have absorption depth ~2.5 μm.

Thus, the cooling efficiency and cooling power for the perovskite platelet with different thickness can be calculated as tabulated in Table S 1. From the calculation it can be seen that the cooling power is maximized at ~8.8 μW obtained with thickness ~2 μm which agrees with present experimental data on net cooling as shown in present disclosure, FIG. 4*d*.

TABLE S1

Estimation of cooling efficiency and cooling power for different thickness pumped at 785 nm with pumping power 0.7 mW.

| Sample Thickness (μm) | $\eta_{ext}$ (%) | $\overline{\lambda}_f$ (nm) | t (μm) | $\eta_c$ (%) | $P_c$ (μW) |
|---|---|---|---|---|---|
| 0.20 | 99.70 | 759 | 0.2 | 3.11 | 1.74 |
| 0.65 | 99.87 | 767 | 0.65 | 2.34 | 4.03 |
| 1.5 | 99.90 | 770 | 1.5 | 1.98 | 7.75 |
| 2.0 | 99.89 | 772 | 2.0 | 1.84 | 8.80 |
| 3.0 | 99.80 | 775 | 2.5 | 1.35 | 6.70 |

Laser Cooling of Perovskite Crystal Prepared by Solution Method

The single crystal $CH_3NH_3PbI_3$ perovskite was grown by drop-casting its 20 wt % solution in γ-butyrolactone on muscovite mica substrate, which was maintained at 100° C. on a hot-plate. After 15 minutes, the solvent was completely evaporated and the crystals were formed around the edges of the droplet. Optical image of the as-grown crystals is shown in FIG. 12(*a*). The crystals are in hexagonal shape and have a flat surface with the dimension around 30-60 μm and thickness of 3-6 μm. The cooling experiment on the crystal was done with the similar setup with CVD grown platelets as discussed in earlier paragraphs and FIG. 7(*b*). The cooling results with a 785 nm excitation are shown in FIGS. 12(*b*) and (*c*).

The data shows that a net cooling of ~20 K from 290 K was obtained with the crystal implying that the laser cooling property of this material can be readily achieved by solution preparation which is scalable and suitable for practical device applications.

Upconversion of Lead Halide Perovskite Family

Figure 13:
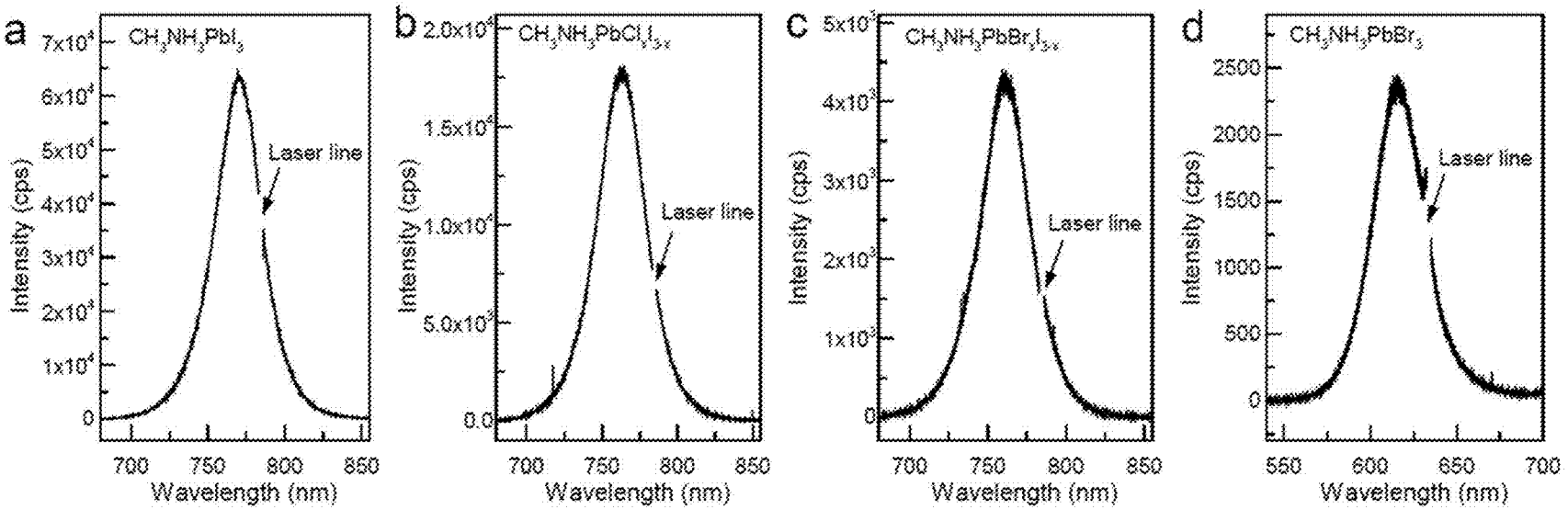
FIG. 13 shows anti-Stokes photoluminescence spectra of different perovskites. (a)-(c) Excitation wavelength at 785 nm with laser power of 10 μW. (d) Excitation wavelength at 633 nm with laser power of 0.5 mW.

Interestingly, the inventors observe that most of compounds in the lead halide perovskite family possess strong anti-Stokes photoluminescence even with single halide or mixed halide perovskites as shown in FIG. 13. With the tunablity of bandgap for this perovskite family from ~400 to 800 nm by changing the combination of halides, there remains a lot of room for optimization to achieve higher cooling efficiency.

Laser Cooling of 2D Perovskite

Beside 3D perovskite cooling described above, the inventors have also observed net laser cooling effect in another member of this perovskite family which is called 2D perovskite. In this material, the $PbI_6$ octahedron layer is sandwiched between two layers of long chain hydrocarbon ammonium (e.g., $C_6H_5CH_2CH_2NH_3$—). As such, the octahedron layers are weakly coupled, forming quantum well structures. This type of material possesses exceptionally large exciton binding energy (where it has been reported to have more than 400 meV for $(C_6H_5CH_2CH_2NH_3)_2PbI_4$ perovskite—a.k.a. $(PhE)_2PbI_4$). This is because the excitons are trapped inside $PbI_6$ quantum well layers. Since the excitons are locally trapped together, there will be less possibility for them to recombine non-radiatively. It is believed that the laser cooling performance would be even more prominent for this 2D type than what was observed in the 3D perovskite (i.e., $CH_3NH_3PbI_3$).

Figure 14:
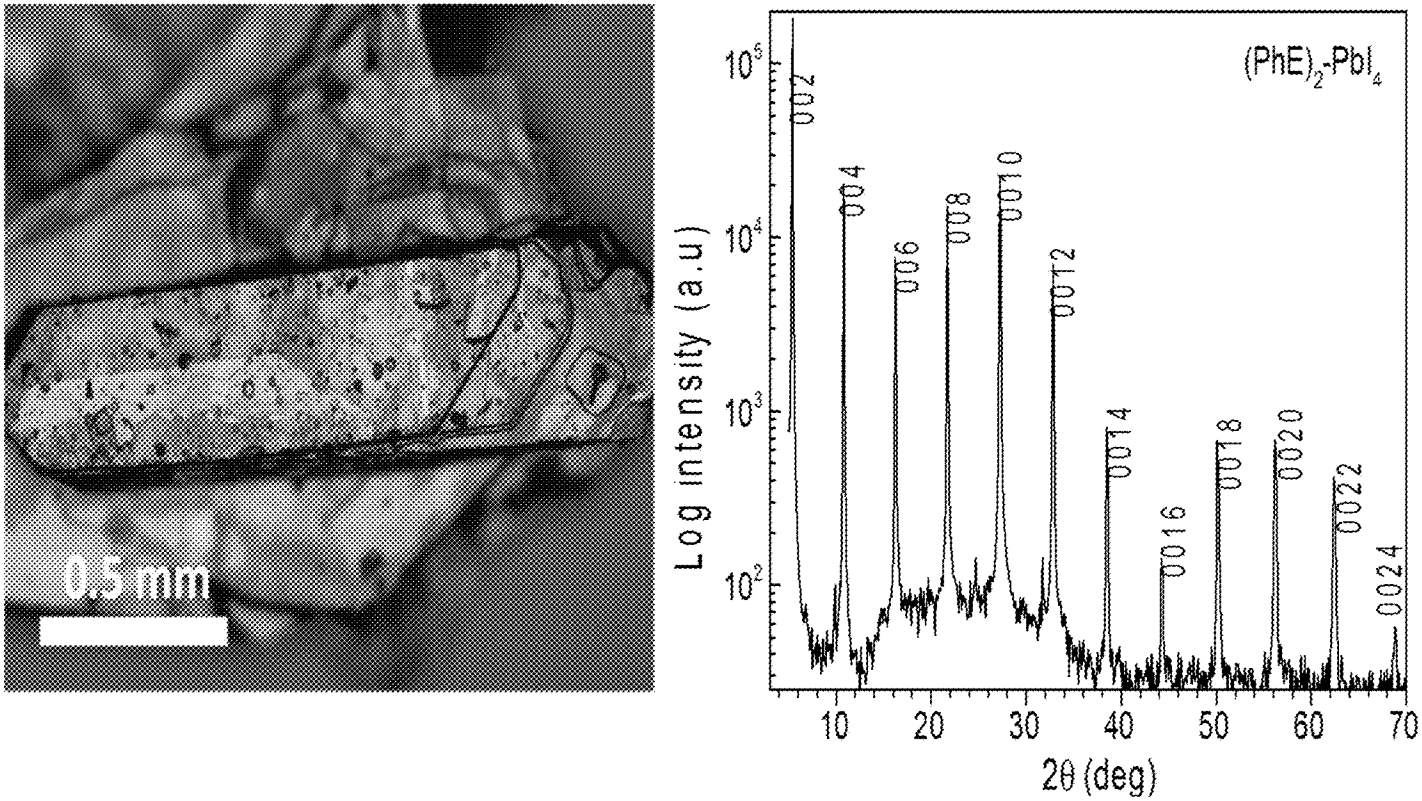
FIG. 14 shows synthesis of $(C_6H_5CH_2CH_2NH_3)_2PbI_4$ perovskite single crystal: Left: Optical image of grown 2D perovskite with lateral size of more than 2 mm. Right: XRD data of single crystal 2D perovskite showing layer structure.

2D perovskite single crystal is grown by hydrothermal method which has been reported in literature with the morphology as shown in FIG. 14, while the XRD suggested a high crystallinity and quantum well structures. The crystal can then be mechanically exfoliated to desired thickness for laser cooling experiments.

Figure 15:
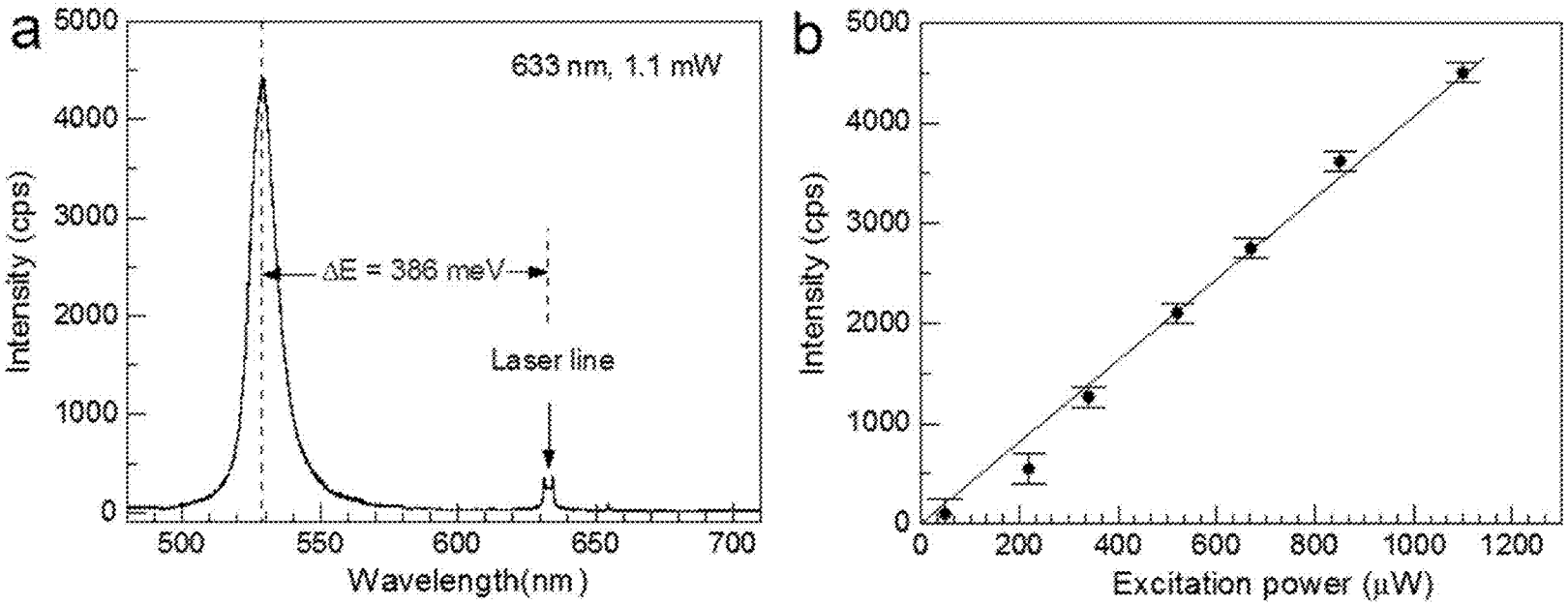
FIG. 15 shows anti-Stoke upconversion photoluminescence in 2D perovskite: (a) Anti-Stoke photoluminescence of $(PhE)_2PbI_4$ when excited by 633 nm laser. (b) Power dependent photoluminescence intensity of $(PhE)_2PbI_4$ excited by 633 nm laser.

The inventors have also investigated the anti-Stoke upconversion photoluminescence of this 2D perovskite as shown in FIG. 15. The results are surprising because this perovskite not only possesses stronger upconversion photoluminescence than that of 3D perovskite but when the inventors excited at ΔE~390 meV lower than the band-gap, the material still showed strong upconversion photoluminescence. This means that theoretically, it requires only minimal ~83% external quantum efficiency in this material to realize laser cooling—an exceptionally low value for a semiconductor compared to previously reported literature. The inventors have also performed power dependence anti-Stoke photoluminescence as showed in FIG. 15(*b*). The result suggested that it is phonon-assisted upconversion photoluminescence which is necessary for laser cooling process.

Figure 16:
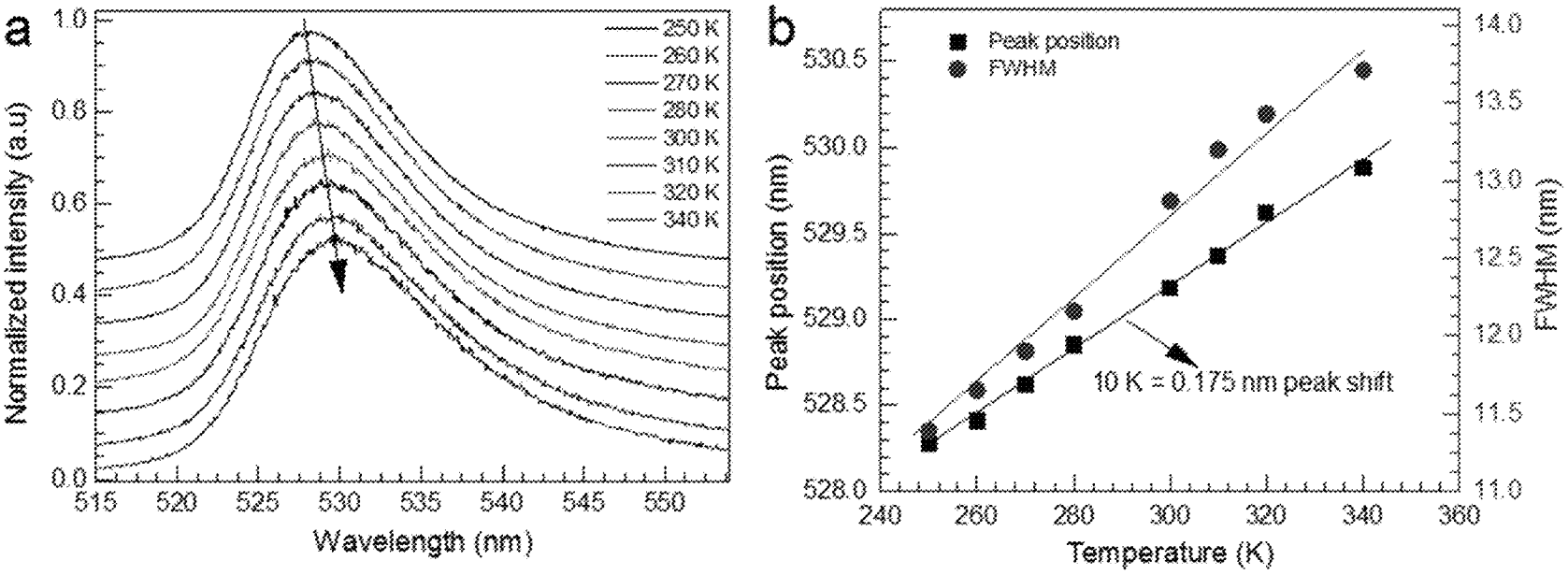
FIG. 16 shows temperature dependence photoluminescence of $(PhE)_2PbI_4$: (a) Temperature dependence photoluminescence spectra from 250 K-340 K. (b) Peak position and FWHM are linearly dependent on temperature. In this regime, each 10K of temperature change is corresponding to 0.175 nm peak shift.

FIG. 16 shows temperature dependence photoluminescence of $(PhE)_2PbI_4$ from 250 K to 340 K excited by 473 nm laser which was used as temperature calibration in the laser cooling experiment. Note that when the temperature decreases, the peak position is blue-shifted and full width half maximum (FWHM) of the spectra decreases. The band blue shifting versus temperature follows traditional semiconductors, but opposites to 3D perovskites. These two variables will both be used as reliable thermometry methods in present laser cooling experiment.

Figure 17:
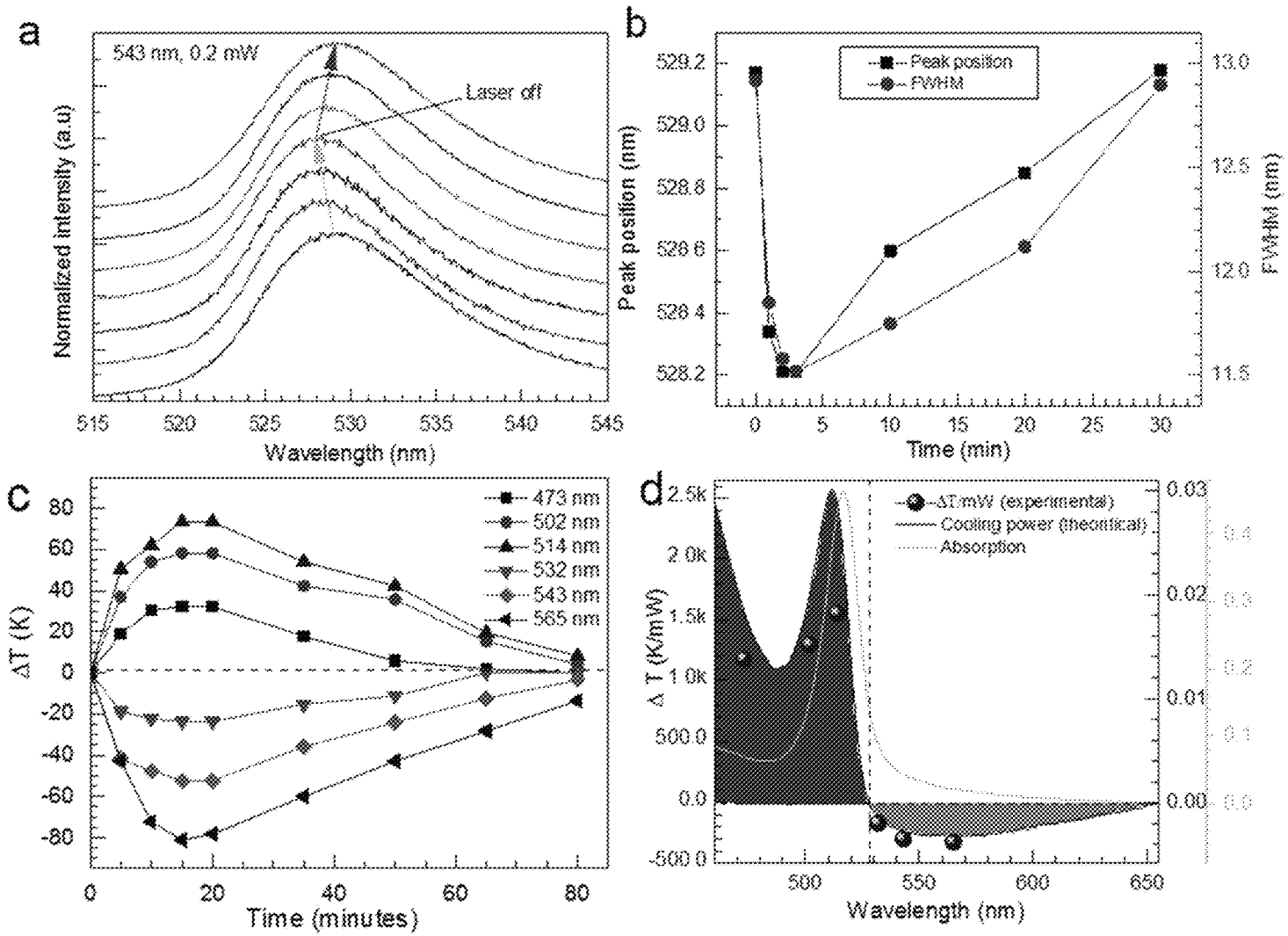
FIG. 17 shows a summary of laser cooling results of $(PhE)_2PbI_4$: (a) Laser cooling spectra when excited by 543 nm laser. (b) Peak position and FWHM evolution during laser cooling experiment extracted from spectra in (a). (c) Laser cooling and heating for various excitation wavelengths. (d) Experimental cooling performance in good agreement with theoretical calculated cooling power.

FIG. 17 summarizes present laser cooling results for the 2D perovskite. As can be seen from FIGS. 17(*a*) and (*b*), when the cooling happened, both peak position and FWHM were in good agreement with the calibration in FIG. 16. This gives a more concrete conclusion that the laser cooling in perovskite material is solid. FIGS. 17(*c*) and (*d*) show both laser cooling and laser heating with various excitation wavelengths for this 2D perovskite. In 2D perovskite crystals, the inventors were able to achieve 80 K cooling, much larger than 3D perovskites.

Synthesis of Organic-Inorganic Lead Halide Perovskite Nanoplatelets

The following paragraphs describe the synthesis of lead halide perovskite family nano-platelets with lateral dimensions from 5-30 μm and thicknesses from several atomic layers to several hundred nanometers. The $CH_3NH_3PbI_3$ platelets prepared by the method have an electron diffusion length of more than 200 nm, which is two times higher than the recently reported value for a film prepared by conventional solution spin-coating.

Figure 18:
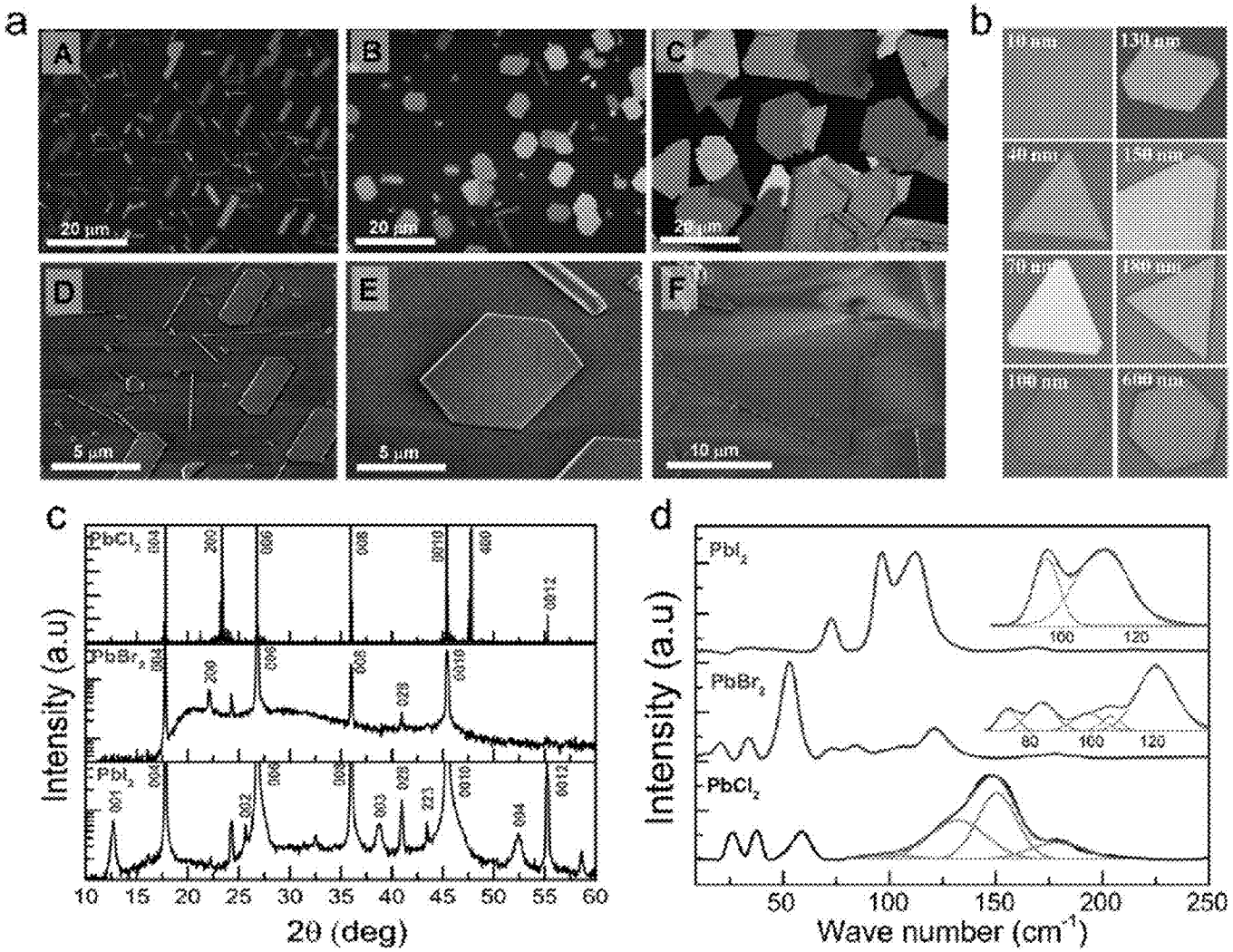
FIG. 18 shows morphological characterizations of lead halides nano-platelets as-grown on muscovite mica substrate: (a) Optical (above) and SEM (below) images of lead halides: A,D: $PbCl_2$; B,E: $PbBr_2$; C,F: $PbI_2$. (b) Optical images of individual $PbI_2$ nano-platelets with different colours corresponding to different thicknesses as measured by AFM. (c) XRD pattern of the platelets, indexed in blue for lead halides and in red for muscovite mica. (d) Raman spectra measured for individual lead halide platelets. Insets: Black curves: experimental data, purple curves: simulation data, green curves: peak fitting.

The method involves two steps: First, the growth of lead halide nano-platelets on muscovite mica utilizing van der Waals epitaxy in a vapor transport chemical deposition system. Next, the as-grown platelets are converted to perovskites by a gas-solid hetero-phase reaction with methyl ammonium halide molecules. FIG. 18(*a*) shows the optical and scanning electron microscopy (SEM) images of lead halides grown on muscovite mica substrates. The difference in colour corresponds to different thicknesses as shown in FIG. 18(*b*) for particular lead iodide platelets. The in-plane orientation of the platelets in the case of $PbCl_2$ and $PbBr_2$ (FIG. 18(*a*): A, B) is evident of the van der Waals epitaxial growth on the muscovite mica substrate because of the three-fold symmetry of the mica surface lattices. The platelets show a highly flat and smooth surface with a surface roughness of only ±1.5 nm as seen by SEM and atomic force microscopy (AFM) (FIG. 18(*a*)).

Figure 20:
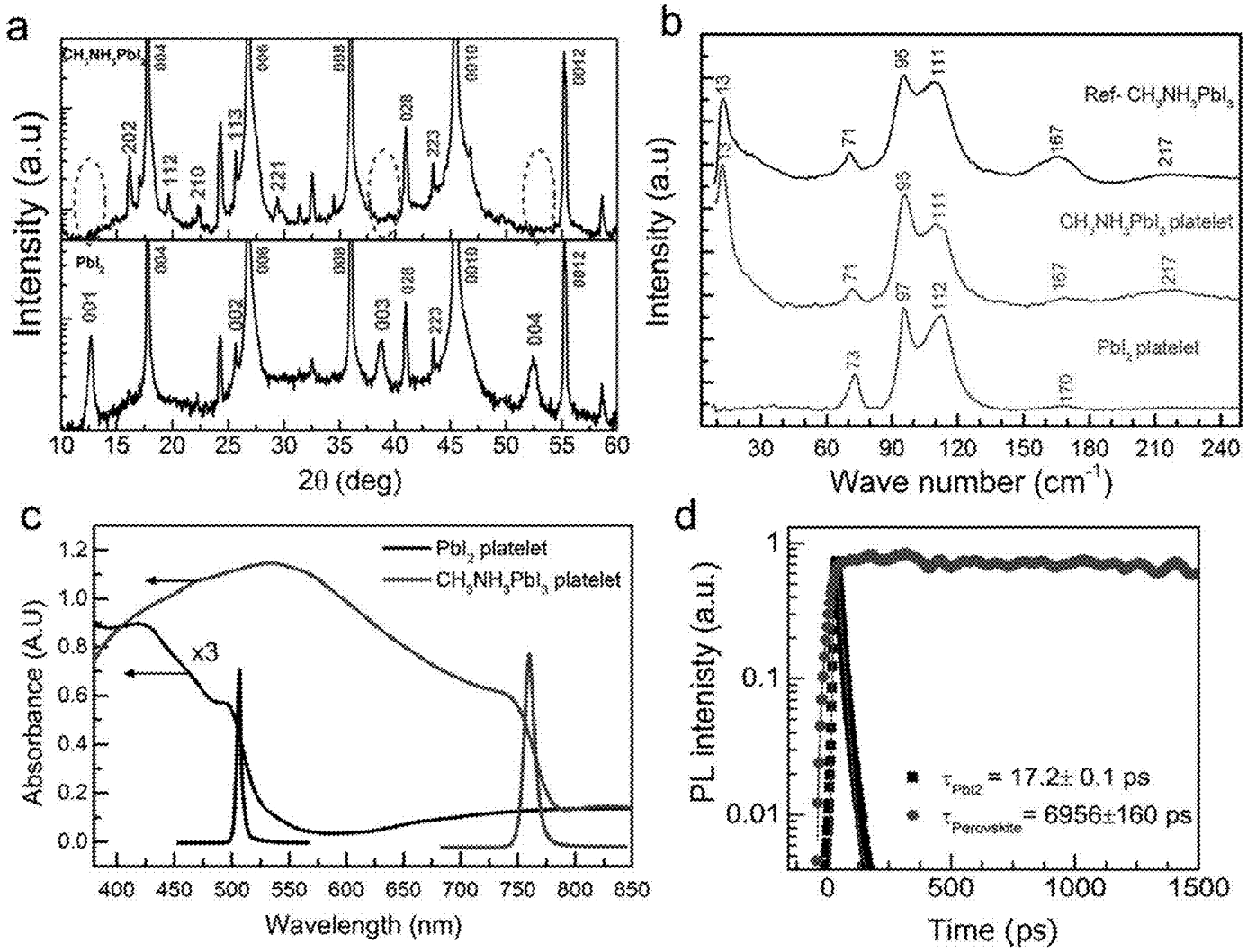
FIG. 20 shows characterizations of lead iodide platelet after conversion to $CH_3NH_3PbI_3$ perovskite. (a) XRD pattern of as-grown $PbI_2$ platelets on muscovite mica (below) and after conversion to $CH_3NH_3PbI_3$ platelets (above). After conversion, the identical peaks of $PbI_2$ (001, 002, 003, 004) disappeared (as shown by the red dashed circle in the XRD spectrum of $CH_3NH_3PbI_3$). Instead, several peaks of tetragonal $CH_3NH_3PbI_3$ (indexed in blue colour) were detected. (b) Raman spectra of the same $PbI_2$ platelet before (green) and after (red) conversion. The blue curve is the Raman spectrum of a bulk $CH_3NH_3PbI_3$ crystal that was synthesized by a solution method for comparison. (c) Optical absorption and photoluminescence (at 77 K) of $PbI_2$ platelet before (black curve) and after conversion to perovskite (red curve). (d) PL lifetime of $PbI_2$ platelet before (black squares) and after (red dots) conversion. The PL lifetime of a $CH_3NH_3PbI_3$ platelet is approximately 400 times larger than that of the corresponding $PbI_2$ platelet.

The as-grown lead halide platelets on mica were characterized by powder X-ray analysis (FIG. 20(*c*)) in θ-θ geometry, meaning that only planes parallel to the surface of the substrate contribute to the patterns. Multiple strong peaks indexed in red correspond to the basal planes of muscovite mica of the $2M_1$ poly-type [$KAl_2(Si_3Al)—O_{10}(OH)_2$, monoclinic, space group: C2/c], whereas peaks indexed in blue correspond to $PbCl_2$, $PbBr_2$, and $PbI_2$. It should be noted that lead halide platelets have a highly oriented growth direction along the a-axis in the case of $PbCl_2$ and $PbBr_2$ and along the c-axis for $PbI_2$. Raman spectroscopy was used to further characterize the crystalline structure of individual platelets for each lead halide compound. All Raman spectra were taken under 633 nm excitation with a laser power of 0.5 mW through a 100× objective at room temperature. The Raman spectra of the as-grown lead halide platelets agree well with their corresponding single-crystal spectra as reported in the literature.

Figure 19:
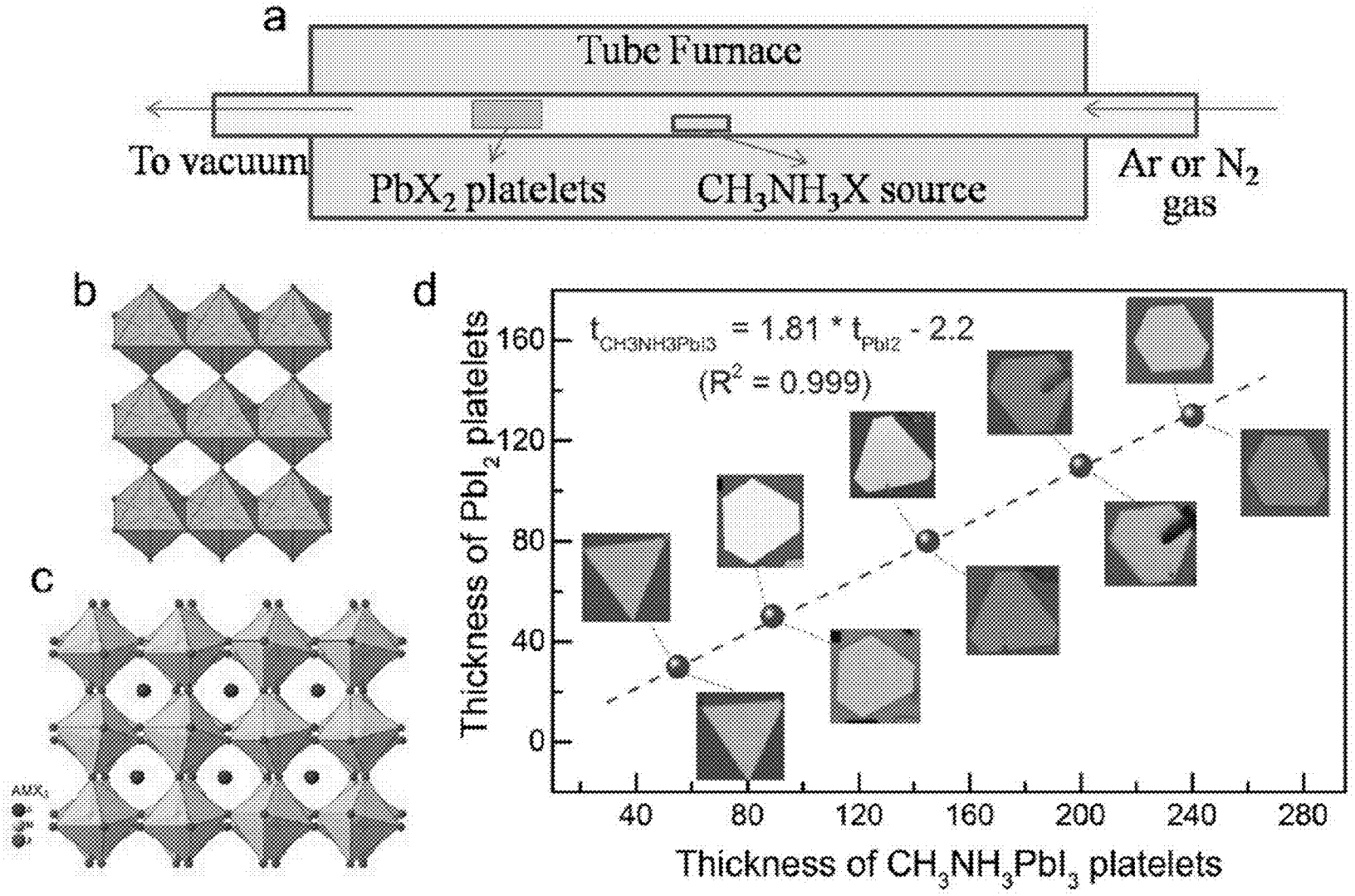
FIG. 19 shows conversion of lead halide nano-platelets to perovskites by gas-solid hetero-phase reaction with methyl ammonium halide ($CH_3NH_3X$, X=Cl, Br, I). (a) Schematic of the synthesis setup using a home-built vapour-transport system. (b) Structure of the lead halide in which the Pb atoms are at the centre of the halide octahedrons. In the same layer, each octahedron shares 2 equatorial halide atoms with its neighbour whereas two octahedrons from two continuous layers share one axial halide atom. (c) Structure of lead halide perovskite $CH_3NH_3PbX_3$ (X=Cl, Br, I) in which each lead halide octahedron shares one equatorial halide atom with its neighbours in the same layer and shares one axial halide atom with neighbours from the next layers. The methyl ammonium group $CH_3NH_3^+$ denoted as a red sphere is located within the centre of eight lead halide octahedrons. The similarity of the lead halide and perovskite structures makes it possible to convert the lead halide solid structure into its perovskite by intercalating methyl ammonium halide molecules. (d) Thickness of $PbI_2$ platelets before (images above data line) and after being converted to $CH_3NH_3PbI_3$ (images below data line). Note that the colour of the $PbI_2$ platelets changed corresponding to the change in thickness (as measured by AFM). The thickness of the $CH_3NH_3PbI_3$ platelets was about 1.8 times higher compared to the corresponding $PbI_2$ platelets, which agrees well with the ratio of the c lattice constant between the two compounds.

The as-grown lead halide platelets or nanowires are then converted into perovskites by reacting with gas-phase methyl ammonium halides. The experimental setup is demonstrated in FIG. 19(*a*). The converting reaction was carried out in a quartz tube in vacuum with an inert carrier gas such as nitrogen or argon. The methyl ammonium halide source was synthesized by a solution method and re-crystallized in diethylether/methanol following the procedure published elsewhere. The source was placed in the centre of the tube furnace where the set temperature (ca. 120° C.) is normally achieved whereas the pre-grown lead halide platelets were placed downstream. The pressure was about 20 Torr FIG. 19(*b*), (*c*) show the crystal structures of lead halide and perovskite with methyl ammonium ($CH_3NH_3^+$) as the cation. As can be seen, both crystal structures have a similar network unit of lead halide octahedrons with the lead atom located in the centre surrounded by halide atoms. Whereas in lead halide each octahedron shares two equatorial halide atoms with its neighbours in the same layer and shares one axial halide atom with its neighbours from different layers forming a layered structure, the octahedrons in lead halide perovskite form a 3D network structure in which each octahedron shares only one halide atom with its neighbours either in the same layer or in a different layer. XRD analysis revealed the hexagonal structure of lead iodide having a lattice constant c=0.695 nm with an orientation perpendicular to the substrate (FIG. 18(*c*)). The perovskite $CH_3NH_3PbI_3$ normally has a tetragonal structure at room temperature with a lattice constant c=1.244 nm. The difference in lattice constant c is due to the insertion of a methyl ammonium group in the centre of eight octahedrons and the relocation of the equatorial halide atoms resulting in a twisting of the lead halide octahedrons as illustrated in FIGS. 19(*b*) and (*c*). Interestingly, the thickness of $PbI_2$ and $CH_3NH_3PbI_3$ platelets (before and after conversion) correlated to each other by a factor of 1.81 (as shown in FIG.

19(*d*)), which agrees well with the lattice constant ratio of the two compounds along the c axis. The observation is also in good agreement with previous work on a $PbI_2$ film, where the film thickness increased by a factor of 1.75 (from 200 nm to 350 nm) after converting to $CH_3NH_3PbI_3$. This provides a good way to control the thickness of perovskite platelets by monitoring the thickness of the corresponding lead halide platelets.

In order to confirm whether the conversion of the lead iodide platelets into their perovskite form had been successful, the inventors investigated the crystalline structure by XRD and the optical properties of the platelets before and after conversion as shown in FIG. 20. FIG. 20(*a*) shows the XRD pattern of as-grown platelets on muscovite mica substrate before and after conversion in the θ-θ geometry. It is clear that after conversion the identical peaks corresponding to 001, 002, 003, 004 of the 2-H lead iodide crystals (space group: P3m1(164), JCPDS file No. 07-0235) disappeared (marked by the dashed-red circles in the XRD pattern of $CH_3NH_3PbI_3$) and several new peaks of tetragonal-phase lead iodide perovskite were observed. Because of the strong peaks of the mica substrate and the slightly twisted structure of the lead iodide octahedrons after conversion, the inventors could not observe the peak corresponding to planes perpendicular to the c-axis as would be expected in the XRD pattern. However, the disappearance of the $PbI_2$ peaks confirmed the completed conversion. The complete conversion of the other halide perovskites, $CH_3NH_3PbBr_3$ and $CH_3NH_3PbCl_3$, were also confirmed by XRD. Raman spectroscopy was conducted before and after conversion (FIG. 22(*b*)). In the $PbI_2$ platelet, the peak at 73 $cm^{-1}$ was assigned to the shearing motion between two iodide layers, Eg, whereas the vibration at 97 $cm^{-1}$ corresponded to the symmetric stretch $A_{1g}$. On the other hand, the Raman spectrum of the $CH_3NH_3PbI_3$ platelets shows a low-frequency vibration located at 13 $cm^{-1}$ and a broad band featured at around 215 $cm^{-1}$. The other vibration peaks of the perovskites are quite similar to that of lead iodide probably due to the similarity in their crystal structures. Nevertheless, the perovskite platelets that were converted from $PbI_2$ platelets showed identical peaks to that of a reference perovskite crystal, implying that it has the same tetragonal structure as that of a solution-grown perovskite crystal. The optical absorption and photoluminescence of lead iodide and its perovskite were also characterized in individual platelets having similar thicknesses (180 nm for $PbI_2$ and 175 nm for $CH_3NH_3PbI_3$) to minimize the effect of the thickness on the optical density as shown in FIG. 20(*c*). It is well-known that lead iodide has an optical absorption at around 500 nm whereas that of $CH_3NH_3PbI_3$ is 770 nm. Moreover, the absorption coefficient of perovskite is also much higher than that of lead iodide. Present data shows similar observation for the two platelets with identical thickness. In addition, after conversion, the platelet showed strong photoluminescence (PL) at room temperature whereas the PL of $PbI_2$ could be obtained only at low temperatures (<200 K). FIG. 20(*c*) also shows the PL of a platelet before and after conversion at 77 K, which is consistent with the optical absorption spectrum. One of the properties that makes $CH_3NH_3PbI_3$ perovskite suitable for solar cell applications is the long diffusion length of its charge carriers, which can be characterized by time-resolved photoluminescence spectroscopy. The lifetime of the charge carriers in the perovskite is exceptionally long so that they can reach the electrodes of the cells before recombination and therefore reduce the loss in power conversion. In order to verify this property of perovskites, the inventors carried out time-resolved photoluminescence of $PbI_2$ and $CH_3NH_3PbI_3$ platelets. The results in FIG. 20(*d*) show that after conversion, the perovskite platelet has a PL lifetime that is more than 400 times higher than that of $PbI_2$. In summary, it is confirmed that the lead iodide platelet was successfully converted to perovskite by thermally intercalating methyl ammonium iodide. This approach can be applied to other lead halide perovskites even with a mixed halide composition as illustrated later.

Figure 21:
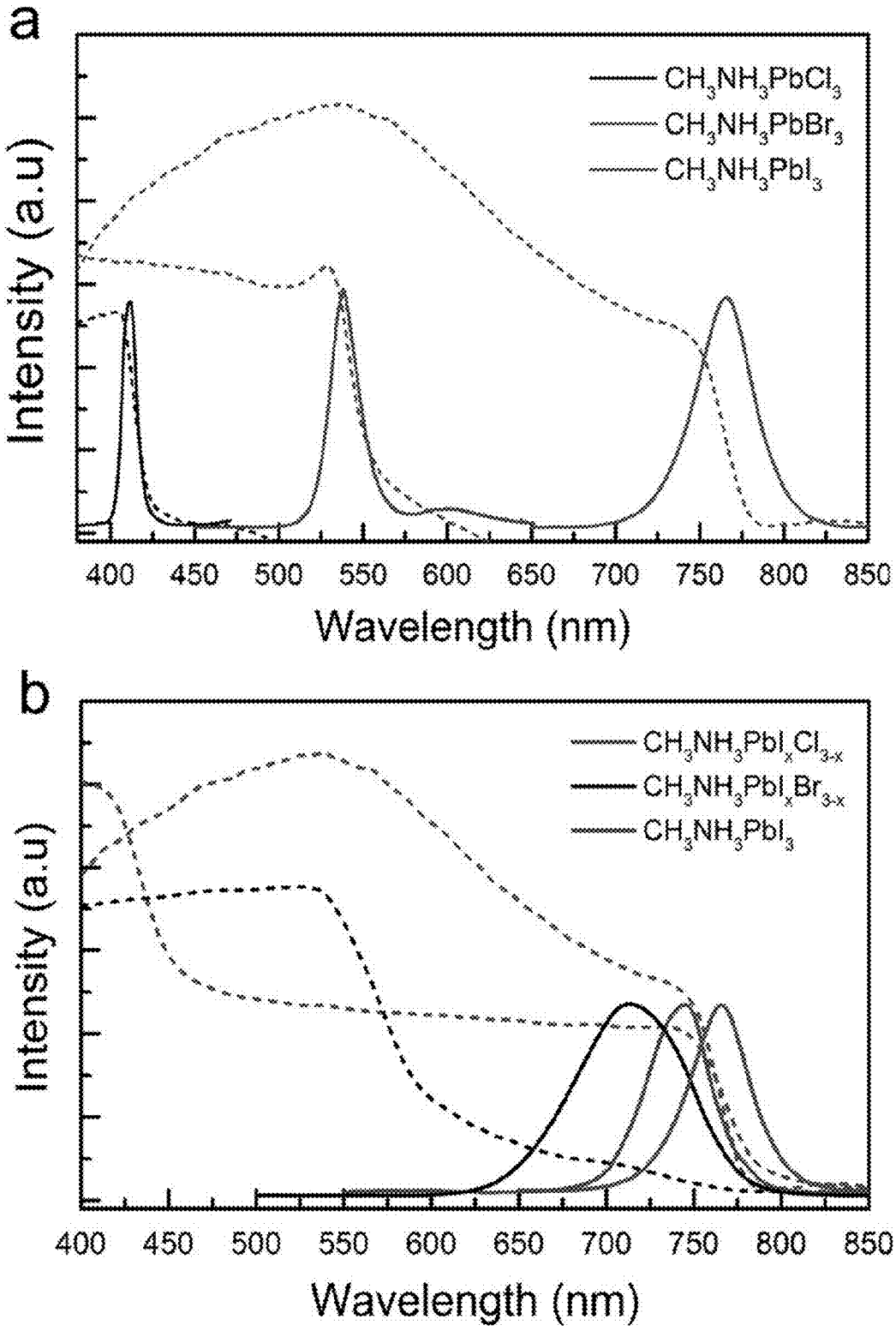
FIG. 21 shows optical absorption (dashed line) and room temperature PL (solid line) of converted lead halide perovskite platelets. (a) Optical properties of different lead halide perovskites ($CH_3NH_3PbX_3$) showing a bandgap of 400 nm for X=Cl, 530 nm for X=Br, and 770 nm for X=I, which are in good agreement with previous reports. (b) Mixed halide perovskite platelets prepared by conversion of lead iodide platelets with different methyl ammonium halides ($CH_3NH_3X$).

FIG. 21(*a*) shows the optical absorption and photoluminescence of different lead halide perovskites synthesized in a similar manner as the $CH_3NH_3PbI_3$ platelets above. The optical absorption reveals that the bandgaps for $CH_3NH_3PBCl_3$, $CH_3NH_3PbBr_3$, and $CH_3NH_3PbI_3$ are at 3.10 eV (400 nm), 2.34 eV (530 nm), and 1.61 eV (770 nm), respectively, which is in good agreement with previous reports. All perovskite compounds show a strong band-edge photoluminescence at room temperature. FIG. 21(*b*) displays the optical characterizations of the mixed halide perovskites prepared by intercalating different methyl ammonium halides ($CH_3NH_3X$, with X=Cl, Br, I) into the $PbI_2$ platelets. The results show that $CH_3NH_3PbI_3$ and $CH_3NH_3PbI_xCl_3$, have a broad absorption covering the entire visible range (400-750 nm), whereas $CH_3NH_3PbI_xBr_{3-x}$ only has a strong absorption in the range of 400-550 nm. This may partially explain why tri-iodide and iodide-chloride perovskites are more suitable for solar cell applications. The mixed chloride-iodide perovskite also shows a stronger absorption in the near-UV regime whereas the pure iodide perovskite has a larger absorption near the 500-600 nm region. This result also suggests that if a combination of the perovskites is used in the absorption layer of solar cells, it would be possible to obtain a higher photo-to-electric conversion efficiency owing to the higher absorption in the whole range of the visible spectrum. By using present synthesis strategy, it is possible to further tune the composition of the lead halide perovskite to obtain an optimal material for solar cell applications, such as co-intercalating a mixture of methyl ammonium halides into lead halide.

Present simple method has shown the advantages of a high crystallinity as demonstrated by the characterizations discussed previously. In order to prove that present perovskite platelets exhibit a higher crystalline quality compared to conventional solution-prepared films, the inventors measured the electron diffusion length in present platelets using $CH_3NH_3PbI_3$ as a case study. The inventors believe that the charge generation and transportation in the perovskite layer are well-correlated with the order and quality of its crystal network. Recently, two groups have reported that the diffusion length for a solution-processed $CH_3NH_3PbI_3$ film is about 100 nm for both the electron and hole. The inventors characterized the electron diffusion length in the $CH_3NH_3PbI_3$ platelets using phenyl-C61-butyric acid methyl ester (PCBM) as a quenching layer.

Figure 22:
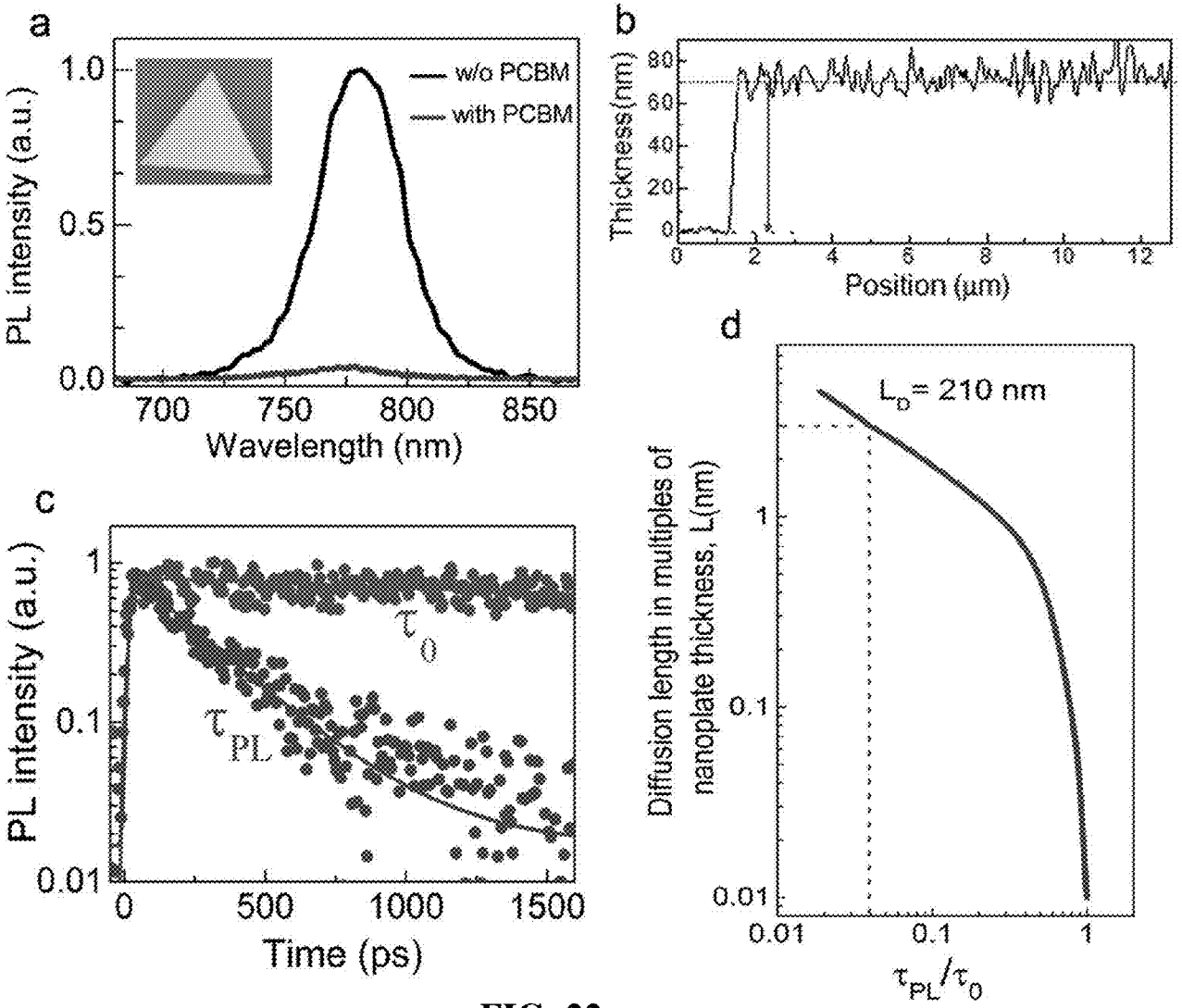
FIG. 22 shows determination of electron-diffusion length in $CH_3NH_3PbI_3$ platelets. (a) Time-integrated PL spectra of as-synthesized $CH_3NH_3PbI_3$ platelet on mica (black curve) and after coating with a PCBM layer (red curve). Inset: Optical image of the measured platelet. (b) Thickness measurement of the platelet using AFM. (c) Time-resolved PL decay transient measured at 760±10 nm for $CH_3NH_3PbI_3$ platelet (green dot) and $CH_3NH_3PbI_3$ platelet/PCBM (purple dot) after excitation at 400 nm. (d) A plot of excitation length versus PL lifetime quenching ratios. The diffusion length is scaled in multiples of $CH_3NH_3PbI_3$ platelet thickness (70 nm).

FIG. 22 displays the experimental results for the estimation of the electron diffusion length in the $CH_3NH_3PbI_3$ nano-platelets. FIG. 22(*a*) shows the steady-state PL spectrum of a —$CH_3NH_3PbI_3$ platelet with a thickness of 70±5 nm with and without a PCBM layer. The thickness of the perovskite platelet used in the experiment was characterized by AFM as shown in FIG. 22(*b*). Using a homogeneous platelet with a small deviation of about 7% the uncertainties of the diffusion length estimation arising from a large variation in the perovskite film thickness could be reduced. FIG. 22(*c*) shows the time-resolved PL decay transient of the perovskite platelet with (purple dots) and without (green dots) a PCBM layer. By fitting the decay dynamics, the PL lifetime of $CH_3NH_3PbI_3$ ($\tau_0$) and $CH_3NH_3PbI_3$/PCBM ($\tau_{PL}$) were found to be 6.8±0.4, and 0.278±0.004 ns, respectively. The inventors then plotted the dependence curve of the charge-carrier diffusion length on the PL lifetime quenching ratio (FIG. 22(*d*)) obtained from an analytical model that was reported elsewhere. Using the same conservative approach, the electron-diffusion length was estimated to be 210±50 nm, which is longer than the minimal estimated values of at least 100 nm reported earlier. This longer diffusion length can be attributed to the high crystal quality of the perovskite platelet prepared by the present method. In conclusion, the inventors have reported a facile method to prepare organic-based lead halide perovskite nano-platelets with a high crystal quality and good optical properties. This synthesis approach will create a new platform to exploit the physical properties of organic-based lead halide perovskites. The synthesized perovskite platelets can be readily applied to numerous applications, such as, single-crystal perovskite solar cells, lasing devices, LEDs, as well as other opto-electronic devices. Furthermore, this synthesis approach can also be applied to prepare perovskite films in planar solar cell configurations, which it believed will further boost the efficiency limits of solar cells.

Figure 23:
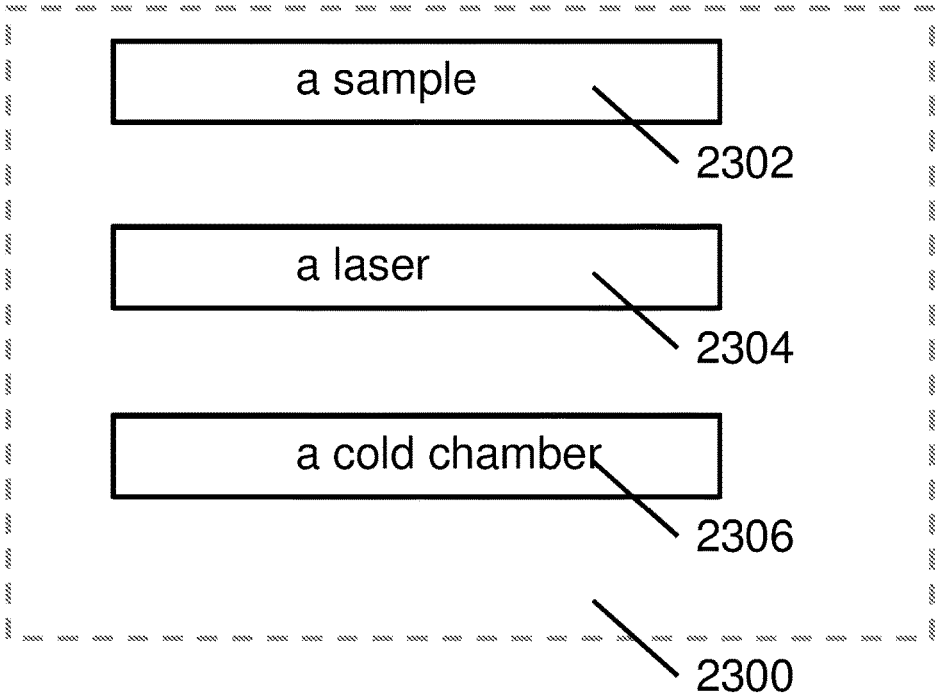
FIG. 23 provides a general illustration of a laser cooling apparatus according to an exemplary embodiment.

FIG. 23 provides a general illustration of a laser cooling apparatus 2300 for cooling a sample, 2302 according to an exemplary embodiment. The apparatus 2300 includes a laser 2304 configured to irradiate the sample 2302. The apparatus 2300 further includes a cold chamber 2306 adapted to provide or maintain a cold environment of 200 K or less to the sample 2302 positioned in the cold chamber 2306. The apparatus 2300 also includes the sample 2302, wherein the sample 2302 includes a perovskite material. The laser 2304 may include any tunable wavelength of between 775 and 800 nm so as to cool the sample 2302 upon irradiation.

Figure 24:
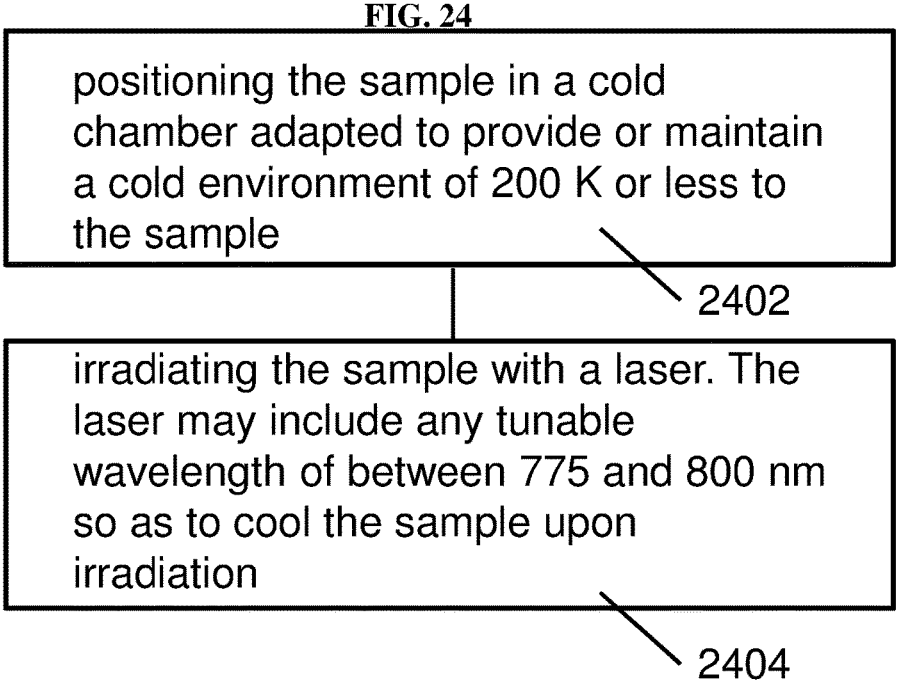
FIG. 24 provides a general illustration of a method for carrying out laser cooling to a sample, according to an exemplary embodiment.

FIG. 24 provides a general illustration of a method for carrying out laser cooling to a sample, according to an exemplary embodiment. The method may include, in 2402, positioning the sample in a cold chamber adapted to provide or maintain a cold environment of 200 K or less to the sample, wherein the sample includes a perovskite material. The method may further include, in 2404, irradiating the sample with a laser. The laser may include any tunable wavelength of between 775 and 800 nm so as to cool the sample upon irradiation.

Experimental Section

Synthesis of Lead Halide Platelets: Either $PbI_2$, or $PbBr_2$, or $PbCl_2$ powder (99.999%, Aldrich) was used as a single source and put into a quartz tube mounted on a single-zone furnace (Lindberg/Blue M TF55035C-1). The freshly cleaved muscovite mica substrate (1 cm×3 cm) was pre-cleaned with acetone and placed in the downstream region inside the quartz tube. The quartz tube was first evacuated to a base pressure of 2 mTorr, followed by a 30 sccm flow of high purity Ar gas premixed with 5% $H_2$ gas. The temperature and pressure inside the quartz tube were set and stabilized to desired values for each halide (380° C. and 200 Torr for $PbI_2$; 350° C. and 75 Torr for $PbBr_2$; and 510° C. and 200 Torr for $PbCl_2$). In all cases, the synthesis was carried out within 20 minutes and the furnace was allowed to cool down naturally to ambient temperature.

Conversion of Lead Halides to Perovskites: The conversions were done using a similar CVD system. Methyl ammonium halides synthesized by a solution method were used as a source and placed in the centre of the quartz tube while mica substrates having as-grown lead halide platelets or nanowires were placed around 5-6 cm away from the centre in the downstream region. The quartz tube was first evacuated to a base pressure of 2 mTorr, followed by a 30 sccm flow of high purity Ar or $N_2$ gas. The pressure was then stabilized to 50 Torr and the temperature was elevated to 120° C. and kept there for 1 hour after which the furnace was allowed to cool down naturally to ambient temperature.

Characterizations: The structure of the as-grown samples was characterized using an optical microscope (Olympus BX51), AFM (Veeco Dimension V) in the tapping mode, field-emission scanning electron microscopy (FE-SEM, JEOL JSM-7001F), and X-ray powder diffraction (XRD, Bruker D8 advanced diffractometer, Cu Kα radiation) in the θ-θ geometry. Absorption spectra were measured by a commercial transmission/reflectance microspectrometer (Craic 20/20). The linearly polarized white light from a Xe lamp was focused onto the sample normally from the bottom. The transmitted light was collected by a reflective objective (36×, numerical aperture: 0.4) and spectrally analysed by a monochromator. An aperture was used to acquire the transmission of light from an area of 15 μm×15 μm, which was chosen to ensure adequate transmission flux and multiple measurements over the whole pattern. Raman spectra were obtained on a triple-grating micro-Raman spectrometer (Horiba-JY T64000). The signal was collected through a 100×objective, dispersed with a 1800 g/mm grating, and detected by a liquid nitrogen cooled charge-coupled device. PL spectra were obtained from the same micro-Raman spectrometer, but with a single-grating setup to improve efficiency. For low-temperature PL measurements the samples were put into a cryostat in advance. The signal was collected through a 50× objective with a long focal length. If not specified, the laser power was kept under 0.50 mW to avoid possible damage and oxidation on the samples.

TRPL Measurements: For time-resolved PL measurements, frequency doubled pulses (400 nm) from a Coherent Mira titanium:sapphire oscillator (120 fs, 76 MHz at 800 nm) was used as the excitation source. The time-resolved PL spectra were obtained using a streak camera system (Optronis GmbH) configured with a fast synchroscan sweep unit (FSSU1-ST) which had an ultimate temporal resolution of around 2 ps including jitter (or ca. 6 ps after coupling with a monochromator) at the fastest scan speed of 15 ps $mm^{-1}$. Typical operating scan speeds in this work were 100 ps $mm^{-1}$.

By "comprising" it is meant including, but not limited to, whatever follows the word "comprising". Thus, use of the term "comprising" indicates that the listed elements are required or mandatory, but that other elements are optional and may or may not be present.

By "consisting of" is meant including, and limited to, whatever follows the phrase "consisting of". Thus, the phrase "consisting of" indicates that the listed elements are required or mandatory, and that no other elements may be present.

The inventions illustratively described herein may suitably be practiced in the absence of any element or elements, limitation or limitations, not specifically disclosed herein. Thus, for example, the terms "comprising", "including", "containing", etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the inventions embodied therein herein disclosed may be resorted to by those skilled in the art, and that such modifications and variations are considered to be within the scope of this invention.

By "about" in relation to a given numerical value, such as for temperature and period of time, it is meant to include numerical values within 10% of the specified value.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

Other embodiments are within the following claims and non-limiting examples. In addition, where features or aspects of the invention are described in terms of Markush groups, those skilled in the art will recognize that the invention is also thereby described in terms of any individual member or subgroup of members of the Markush group.

REFERENCES

1. Pringsheim, P. Zwei Bemerkungen über den Unterschied von Lumineszenz- und Temperaturestrahlung. Z. Phys. A 57, 739-746 (1929).
2. Epstein, R. I. Observation of laser-induced fluorescent cooling of solid. Nature 377, 500-503 (1995).
3. Gosnell, T. R. Laser cooling of a solid by 65K starting from room temperature. Opt. Lett. 24, 1041-1043 (1999).
4. Seletskiy, D. V. et al. Laser cooling of solids to cryogenic temperatures. Nature Photon. 4, 161-164 (2010).
5. Seletskiy, D. V. et al. Local laser cooling of Yb:YLF to 110 K. Opt. Express 19, 18229-18236 (2011).
6. Melgaard, S., Seletskiy, D., Polyak, V., Asmerom, Y. & Sheik-Bahae, M. Identification of parasitic losses in Yb:YLF and prospects for optical refrigeration down to 80K. Opt. Express 22, 7756-7764 (2014).
7. Zhang, J., Li, D., Chen, R. & Xiong, Q. H. Laser cooling of a semiconductor by 40 kelvin. Nature 493, 504-508 (2013).
8. Sheik-Bahae, M. & Epstein, R. I. Optical refrigeration. Nature Photon. 1, 693-699 (2007).
9. Sheik-Bahae, M. & Epstein, R. I. Can Laser Light Cool Semiconductors? Phys. Rev. Lett. 92, 247403 (2004).
10. Burschka, J. et al. Sequential deposition as a route to high-performance perovskite-sensitized solar cells. Nature 499, 316-319 (2013).
11. Lee, M. M., Teuscher, J., Miyasaka, T., Murakami, T. N. & Snaith, H. J. Efficient hybrid solar cells based on meso-superstructured organometal halide perovskites. Science 338, 643-647 (2012).
12. Stranks, S. D. et al. Electron-hole diffusion lengths exceeding 1 micrometer in an organometal trihalide perovskite absorber. Science 342, 341-344 (2013).
13. Xing, G. et al. Long-range balanced electron- and hole-transport lengths in organic-inorganic $CH_3NH_3PbI_3$. Science 342, 344-347 (2013).
14. Xing, G. et al. Low-temperature solution-processed wavelength-tunable perovskites for lasing. Nature materials 13, 476-480 (2014).
15. Wehrenfennig, C., Eperon, G. E., Johnston, M. B., Snaith, H. J. & Herz, L. M. High Charge Carrier Mobilities and Lifetimes in Organolead Trihalide Perovskites. Adv. Mater. 26, 1584-1589 (2014).
16. Ha, S. T., Liu, X. F., Zhang, Q., Sum, T. C. & Xiong, Q. H. Synthesis of organic-inorganic lead halide perovskite nanoplatelets: Towards high performance perovskite solar cells and opto-electronic devices. Adv. Opt. Mat. (2014).
17. Baikie, T. et al. Synthesis and crystal chemistry of the hybrid perovskite $(CH_3NH_3)PbI_3$ for solid-state sensitised solar cell applications. J. Mater. Chem. A 1, 5628-5641 (2013).
18. Yu, C. L. et al. Temperature dependence of the band gap of perovskite semiconductor compound $CsSnI_3$. J. Appl. Phys. 110, 063526 (2011).
19. Roosbroeck, W. V. & Shockley, W. Photon-Radiative Recombination of Electrons and Holes in Germanium. Phys. Rev. 94 (1954).
20. Mosconi, E., Amat, A., Nazeeruddin, M. K., Gräzel, M. & De Angelis, F. First-Principles Modeling of Mixed Halide Organometal Perovskites for Photovoltaic Applications. J. Phys. Chem. C 117, 13902-13913 (2013).
21. Stoumpos, C. C., Malliakas, C. D. & Kanatzidis, M. G. Semiconducting tin and lead iodide perovskites with organic cations: phase transitions, high mobilities, and near-infrared photoluminescent properties. Inorganic chemistry 52, 9019-9038 (2013).
22. Garcia-Adeva, A. J., Balda, R. & Fernandez, J. Upconversion cooling of Er-doped low-phonon fluorescent solids. Phys. Rev. B 79, 033110 (2009).
23. Chen, R. et al. Excitonic Properties and Near-Infrared Coherent Random Lasing in Vertically Aligned CdSe Nanowires. Advanced Materials 23, 1404-1408 (2011).
24. Utama, M. I. et al. Vertically aligned cadmium chalcogenide nanowire arrays on muscovite mica: a demonstration of epitaxial growth strategy. Nano letters 11, 3051-3057 (2011).
25. http://www.cmmp-france.com/micamugb.html.
26. Khurgin, J. B. Band gap engineering for laser cooling of semiconductors. J. Appl. Phys. 100, 113116 (2006).
27. Khurgin, J. B. Surface plasmon-assisted laser cooling of solids. Phys. Rev. Lett. 98, 177401 (2007).
28. Khurgin, J. B. Role of bandtail states in laser cooling of semiconductors. Phys. Rev. B 77, 235206 (2008).
29. Rupper, G., Kwong, N. H. & Binder, R. Large excitonic enhancement of optical refrigeration in semiconductors. Phys. Rev. Lett. 97, 117401 (2006).
30. Mitzi, D. B. Thin-film deposition of organic-inorganic hybrid materials. Chem. Mater. 13, 3283-3298 (2001).
31. Kitazawa, N. & Watanabe, Y. Optical properties of natural quantum-well compounds $(C_6H_5—CnH_2n-NH_3)_{(2)}PbBr_4$ (n=1-4). J. Phys. Chem. Solids 71, 797-802 (2010).
32. Imangholi, B. Investigation of laser cooling in semiconductors PhD thesis, The University of New Mexico, (2006).
33. M. Liu, M. B. Johnston, H. J. Snaith, Nature 2013, 501, 395.
34. J. H. Heo, S. H. Im, J. H. Noh, T. N. Mandal, C. S. Lim, J. A. Chang, Y. H. Lee, H. J. Kim, A. Sarkar, M. K. Nazeeruddin, M. Grä tzel, S. I. Seok, Nat. Photonics 2013, 7, 486.
35. A. Kojima, K. Teshima, Y. Shirai, T. Miyasaka, J. Am. Chem. Soc. 2009, 131, 6050.
36. J. H. Noh, S. H. Im, J. H. Heo, T. N. Mandal, S. I. Seok, Nano Lett. 2013, 13, 1764.
37. L. Etgar, P. Gao, Z. S. Xue, Q. Peng, A. K. Chandiran, B. Liu, M. K. Nazeeruddin, M. Gräzel, J. Am. Chem. Soc. 2012, 134, 17 396.

38. B. Cai, Y. Xing, Z. Yang, W. H. Zhang, J. S. Qiu, Energy Environ. Sci. 2013, 6, 1480.
39. C. R. Kagan, D. B. Mitzi, C. D. Dimitrakopoulos, Science 1999, 286, 945.
40. K. Chondroudis, D. B. Mitzi, Chem. Mater. 1999, 11, 3028.
41. T. Hattori, T. Taira, M. Era, T. Tsutsui, S. Saito, Chem. Phys. Lett 1996, 254, 103.
42. L. C. Schmidt, A. Pertegas, S. G. Carrero, O. Malinkiewicz, S. Agouram, G. M. Espallargas, H. J. Bolink, R. E. Galian, J. P. Prieto, J. Am. Chem. Soc. 2014, 136, 850.
43. D. B. Mitzi, M. T. Prikas, K. Chondroudis, Chem. Mater. 1999, 11, 542.
44. K. Liang, D. B. Mitzi, M. T. Prikas, Chem. Mater. 1998, 10, 403.
45. J. Zhang, Z. Peng, A. Soni, Y. Y. Zhao, Y. Xiong, B. Peng, J. B. Wang, M. S. Dresselhaus, Q. H. Xiong, Nano Lett. 2011, 11, 2407.
46. N. Chen, S. H. Chen, C. B. Ouyang, Y. W. Yu, T. F. Liu, Y. J. Li, H. B. Liu, Y. L. Li, NPG Asia Mater. 2013, 5, 1.
47. P. Krogstrup, H. I. Jørgensen, M. Heiss, O. Demichel, J. V. Holm, M. Aagesen, J. Nygard, A. F. i Morral, Nat. Photonics 2013, 7, 306.
48. D. H. Li, J. Zhang, Q. H. Xiong, ACS Nano 2012, 6, 5283.
49. M. I. B. Utama, M. de la Mata, C. Magen, J. Arbiol, Q. H. Xiong, Adv. Funct. Mater. 2013, 23, 1636.
50. M. Gillet, R. Delamare, E. Gillet, J. Cryst. Growth 2005, 279, 93.
51. I. Matohnova, M. Gillet, E. Gillet, V. Matohn, Nanotechnology 2009, 20, 445 604.
52. Z. X. Wang, T. Kong, K. Zhang, H. L. Hu, X. P. Wang, J. G. Hou, J. Chen, Mater. Lett. 2007, 6, 251.
53. M. I. B. Utama, F. J. Belarre, C. Magen, B. Peng, J. Arbiol, Q. H. Xiong, Nano Lett. 2012, 12, 2146.
54. G. K. Kasi, N. R. Dollahon, T. S. Ahmadi, J. Phys. D: Appl. Phys. 2007, 40, 1778.
55. G. A. Ozin, Can. J. Chem. 1970, 48, 2931.
56. Q. Chen, H. Zhou, Z. Hong, S. Luo, H. S. Duan, H. H. Wang, Y. S. Liu, G. Li, Y. Yang, J. Am. Chem. Soc. 2014, 136, 622.
57. Z. Zheng, A. Liu, S. Wang, Y. Wang, Z. S. Li, W. M. Lau, L. Z. Zhang, J. Mater. Chem. 2005, 15, 4555.
58. M. R. Tubbs, Phys. Stat. Sol. 1972, 49, 11.
59. N. Kitazawa, Y. Watanabe, Y. Nakamura, J. Mater. Sci. 2002, 37, 3585.
60. K. Tanaka, T. Takahashi, T. Ban, T. Kondo, K. Uchid, N. Miura, Sol. Stat. Comm. 2003, 127, 619.
61. US 2013/0336348 A1

The invention claimed is:

1. A laser cooling apparatus for cooling a sample, the apparatus comprising:

a laser configured to irradiate the sample;

a cold chamber adapted to provide or maintain a cold environment of 200 K or less to the sample positioned in the cold chamber; and the sample, wherein the sample comprises a perovskite material;

wherein the laser comprises any tunable wavelength of between 775 nm and 800 nm so as to cool the sample upon irradiation.

2. The apparatus of claim 1, wherein the sample comprises an organic-inorganic lead halide perovskite material.

3. The apparatus of claim 2, wherein the sample comprises $CH_3NH_3PbI_3$, $CH_3NH_3PbCl_3$, $CH_3NH_3PbBr_3$, $CH_3NH_3PbICl_2$, $CH_3NH_3PbIBr_2$, $CH_3NH_3PbClI_2$, $CH_3NH_3PbClBr_2$, $CH_3NH_3PbBrI_2$, $CH_3NH_3PbBrCl_2$, or $CH_3NH_3PbIClBr$.

4. The apparatus of claim 3, wherein the sample comprises $CH_3NH_3PbI_3$.

5. The apparatus of claim 2, wherein the sample comprises $(C_6H_5CH_2CH_2NH_3)_2PbI_4$, $(C_6H_5CH_2CH_2NH_3)_2PbCl_4$, $(C_6H_5CH_2CH_2NH_3)_2PbBr_4$, $(C_6H_5CH_2CH_2NH_3)_2PbICl_3$, $(C_6H_5CH_2CH_2NH_3)_2PbICl_2Br$, $(C_6H_5CH_2CH_2NH_3)_2PbIClBr_2$, $(C_6H_5CH_2CH_2NH_3)_2PbIBr_3$, $(C_6H_5CH_2CH_2NH_3)_2PbIBr_2Cl$, $(C_6H_5CH_2CH_2NH_3)_2PbIBrCl_2$, $(C_6H_5CH_2CH_2NH_3)_2PbI_2Cl_2$, $(C_6H_5CH_2CH_2NH_3)_2PbI_2ClBr$, $(C_6H_5CH_2CH_2NH_3)_2PbI_2Br_2$, $(C_6H_5CH_2CH_2NH_3)_2PbI_3Cl$, or $(C_6H_5CH_2CH_2NH_3)_2PbI_3Br$.

6. The apparatus of claim 5, wherein the sample comprises $(C_6H_5CH_2CH_2NH_3)_2PbI_4$.

7. The apparatus of claim 1, wherein the cold chamber comprises a cryostat.

8. A method for carrying out laser cooling to a sample, the method comprising:

positioning the sample in a cold chamber adapted to provide or maintain a cold environment of 200 K or less to the sample, wherein the sample comprises a perovskite material; and irradiating the sample with a laser;

wherein the laser comprises any tunable wavelength of between 775 nm and 800 nm so as to cool the sample upon irradiation.

9. The method of claim 8, wherein the sample comprises an organic-inorganic lead halide perovskite material.

10. The method of claim 9, wherein the sample comprises $CH_3NH_3PbI_3$, $CH_3NH_3PbCl_3$, $CH_3NH_3PbBr_3$, $CH_3NH_3PbICl_2$, $CH_3NH_3PbIBr_2$, $CH_3NH_3PbClI_2$, $CH_3NH_3PbClBr_2$, $CH_3NH_3PbBrI_2$, $CH_3NH_3PbBrCl_2$, or $CH_3NH_3PbIClBr$.

11. The method of claim 10, wherein the sample comprises $CH_3NH_3PbI_3$.

12. The method of claim 9, wherein the sample comprises $(C_6H_5CH_2CH_2NH_3)_2PbI_4$, $(C_6H_5CH_2CH_2NH_3)_2PbCl_4$, $(C_6H_5CH_2CH_2NH_3)_2PbBr_4$, $(C_6H_5CH_2CH_2NH_3)_2PbICl_3$, $(C_6H_5CH_2CH_2NH_3)_2PbICl_2Br$, $(C_6H_5CH_2CH_2NH_3)_2PbIClBr_2$, $(C_6H_5CH_2CH_2NH_3)_2PbIBr_3$, $(C_6H_5CH_2CH_2NH_3)_2PbIBr_2Cl$, $(C_6H_5CH_2CH_2NH_3)_2PbIBrCl_2$, $(C_6H_5CH_2CH_2NH_3)_2PbI_2Cl_2$, $(C_6H_5CH_2CH_2NH_3)_2PbI_2ClBr$, $(C_6H_5CH_2CH_2NH_3)_2PbI_2Br_2$, $(C_6H_5CH_2CH_2NH_3)_2PbI_3Cl$, or $(C_6H_5CH_2CH_2NH_3)_2PbI_3Br$.

13. The method of claim 12, wherein the sample comprises $(C_6H_5CH_2CH_2NH_3)_2PbI_4$.

14. The method of claim 8, wherein the cold chamber comprises a cryostat.

15. The method of claim 8, wherein the sample is positioned on a mica substrate.

16. The method of claim 15, wherein the mica substrate is suspended between two supporters.

17. The apparatus of claim 1, further comprising:

a mica substrate;

wherein the sample is positioned on the mica substrate.

18. The apparatus of claim 17, further comprising:

two supporters configured to support the mica substrate.

* * * * *